US011143474B2

(12) United States Patent
Maldonado

(10) Patent No.: US 11,143,474 B2
(45) Date of Patent: Oct. 12, 2021

(54) MAGAZINE WITH AUTOMATIC EJECTION AND BREECH DETECTION

(71) Applicant: Ruben Maldonado, Riverside, CA (US)

(72) Inventor: Ruben Maldonado, Riverside, CA (US)

( * ) Notice: Subject to any disclaimer, the term of this patent is extended or adjusted under 35 U.S.C. 154(b) by 203 days.

(21) Appl. No.: 16/267,315

(22) Filed: Feb. 4, 2019

(65) Prior Publication Data

US 2020/0248977 A1 Aug. 6, 2020

(51) Int. Cl.

| | |
|---|---|
| ***F41A 17/38*** | (2006.01) |
| ***F41A 3/66*** | (2006.01) |
| ***F41A 11/00*** | (2006.01) |
| ***F41A 9/59*** | (2006.01) |
| ***F41A 3/72*** | (2006.01) |

(52) U.S. Cl.

CPC ..... *F41A 17/38* (2013.01); *F41A 3/66* (2013.01); *F41A 3/72* (2013.01); *F41A 9/59* (2013.01); *F41A 11/00* (2013.01)

(58) Field of Classification Search

CPC .... F41A 17/38; F41A 3/66; F41A 3/72; F41A 9/59; F41A 11/00

USPC ..... 42/6

See application file for complete search history.

(56) References Cited

U.S. PATENT DOCUMENTS

| | | | | |
|---|---|---|---|---|
| 1,400,252 | A | 12/1921 | Weed | |
| 5,473,834 | A | 12/1995 | Bammate | |
| 7,806,293 | B2 * | 10/2010 | Altieri | F42B 39/002 221/185 |
| 8,151,503 | B2 | 4/2012 | Oz | |
| 8,726,554 | B2 | 5/2014 | Klassen | |
| 9,097,474 | B1 | 8/2015 | Zins et al. | |
| 9,651,327 | B2 | 5/2017 | Hoon | |
| 9,803,943 | B2 | 10/2017 | Schafer et al. | |
| 10,386,141 | B2 * | 8/2019 | Harris | F41A 9/70 |
| 10,563,941 | B2 * | 2/2020 | Chen | F41A 17/34 |
| 10,767,944 | B2 * | 9/2020 | Chen | F41A 9/59 |
| 2005/0183310 | A1 | 8/2005 | Finn | |
| 2011/0010977 | A1 | 1/2011 | Quis | |
| 2011/0154708 | A1 | 6/2011 | Oz | |
| 2013/0269232 | A1 | 10/2013 | Harris | |
| 2014/0325886 | A1 * | 11/2014 | Mather | F41A 17/38 42/6 |
| 2015/0033608 | A1 | 2/2015 | Power | |
| 2015/0241162 | A1 * | 8/2015 | Geraghty | F41A 9/65 42/6 |
| 2015/0316339 | A1 | 11/2015 | Young | |
| 2016/0076841 | A1 * | 3/2016 | Ballard | F41A 9/65 42/50 |
| 2016/0258700 | A1 | 9/2016 | Schafer et al. | |

(Continued)

*Primary Examiner* — Joshua E Freeman

(74) *Attorney, Agent, or Firm* — Kenneth Avila

(57) ABSTRACT

The present invention discloses enhancements for a follower within a magazine for an automatic rifle. The disclosed follower contains mechanisms that will (i) disengage the magazine from the automatic rifle once the last round has been removed from the magazine; (ii) minimize the amount of friction between the follower and the inner wall of the magazine; and (iii) detect if the automatic rifle has been breeched prior to disengaging the magazine from the automatic rifle. The disclosure also provides for a takedown pin that will have selectable positions to allow for a full breech, partial breech, and a normal firing mode.

3 Claims, 22 Drawing Sheets

(56) References Cited

U.S. PATENT DOCUMENTS

| | | | | |
|---|---|---|---|---|
| 2016/0348992 | A1* | 12/2016 | Tisone | F41A 9/70 |
| 2017/0160026 | A1 | 6/2017 | Walther et al. | |
| 2018/0149438 | A1* | 5/2018 | Headrick | F41A 9/65 |
| 2018/0156557 | A1 | 6/2018 | Abbott et al. | |
| 2019/0128628 | A1* | 5/2019 | Jen | F41A 9/66 |

* cited by examiner

MAGAZINE WITH AUTOMATIC EJECTION AND BREECH DETECTION

BACKGROUND OF THE INVENTION

1. Field of the Invention

The present invention is generally related to ammunition magazines for automatic or semi-automatic rifles. In particular, the present invention is directed to a modification in an ammunition magazine to facilitate removal of the magazine when the magazine has been emptied of cartridges or when the magazine has been emptied of cartridges and the rifle has been breached.

2. Description of the Related Art

Automatic or semi-automatic rifles ("AR") have been in use over the past decades and are popular for military, law enforcement, and sporting purposes because ARs allow for the placement of multiple rounds, also known as bullets or cartridges, at a desired target downrange in a short period of time thus increasing the likelihood that the desired target has been rendered ineffective. Due to the rapid rate that ARs may place rounds at a desired target, devices have been manufactured that allow for the storage of multiple rounds so that the shooter may concentrate on tracking the desired target. These devices, called magazines, have been manufactured in such a manner so that they allow for the replacement of a magazine that has been emptied with a loaded magazine in just a few simple steps.

A magazine, as generally known in the industry, is a hollow rectangular container of a certain height, length, and width wherein the height is greater than the length and the length is greater than the width and the width is sufficient for at least one round but less than two rounds. All sides of the magazine is bounded except for the top. Within a magazine is a platform, referred to in the industry as a follower, that is biased towards the top of the magazine by a compression spring within the magazine positioned between the follower and the base of the magazine. Rounds are inserted into the magazine from the top and onto the follower, compressing the spring as additional rounds are inserted. Flanges at the top of the magazine requires that the rounds be inserted and removed laterally from the magazine and prevents the rounds from being ejected upwardly from the magazine by means of the spring biasing the follower towards the top of the magazine. Typically, the magazine also contains a port to engage a catch mechanism found on the AR to lock the magazine into position prior to firing the AR. As mechanisms in the AR removes rounds from the magazine the compression spring biases the follower to move towards the top of the magazine so that the topmost round in the magazine is in position to be removed by the mechanisms in the AR.

To replace a spent magazine the shooter must first activate the catch mechanism to disengage the spent magazine from the AR. Second, the shooter must remove the disengaged magazine from the AR by pulling the magazine out of the AR. Third, the shooter must insert a loaded magazine. Finally, the shooter must re-engage the catch mechanism to lock the loaded magazine into position. Although these steps may be done in rapid succession by a trained shooter, the shooter nonetheless must divert attention away from the target and possibly lose the target once the loaded magazine has been properly engaged. There have been disclosures that attempt to reduce the time involved in replacing a spent magazine with a loaded magazine, in particular the first two steps: activating the mechanism to release the spent magazine and then removing the spent magazine from the AR.

In some states within the United States, additional steps are added to this sequence in ARs sold to the general public to purposefully slow the shooter while exchanging a spent magazine with a loaded magazine. One additional step is requiring the shooter to use a special tool to disengage the catch mechanism and release the magazine. Another step is to require the AR to be placed in the breach position prior to activating the catch mechanism to disengage the magazine.

US patent publication 2016/0348992 to Tisone and others attempts to simplify the process of removing a spent magazine from an AR. Tisone includes modifications to follower 14 to effect automatic ejection of an ammunition magazine from a weapon, once the last round has left the magazine. The modification consists of a prong 143 and a compression spring 144 within follower 14. The prong 143 is biased by the compression spring 144 to protrude out of follower 14. As follower 14 moves up and down within the magazine the prong 143 is kept within follower 14 as the wall of the magazine prevents the prong 143 from protruding. However, after the last round has left the magazine, the subsequent upward movement by follower 14 will position the prong 143 across the magazine catch mechanism. The compression spring 144 will bias the prong 143 to engage the catch mechanism so as to release the magazine automatically without any action on the part of the shooter. Although the Tisone disclosure is able to activate the catch mechanism to release the magazine, it is deficient in other ways. First is that the compression spring 144 must have a high spring constant to bias the prong 143 making it more difficult to install the compression spring 144. In addition, the prong 143 is continually making contact with the inner wall of the magazine causing increased wear on the inner wall of the magazine and to the tip of the prong 143. Finally, the Tisone disclosure does not provide a means to force the magazine out of the AR once the catch mechanism has been disengaged. Due to normal friction forces, the magazine may not fall away from the AR requiring the shooter to manually remove the magazine from the AR.

US patent publication 2018/0149438 to Headrick and others is similar to the Tisone disclosure and is comprised of a magazine which automatically ejects from the lower receiver of the AR when the magazine is spent and a control group comprising a magazine release mechanism for releasing the magazine catch so that the magazine is detachable from the lower receiver. In Headrick, follower 56 is modified to include a protrusion 66 along the side of follower 56 that moves within channel 52 of magazine 30. Once protrusion 66 enters the magazine catch port in channel 52, magazine catch release 72 is pushed out of the magazine catch port freeing magazine 30 to be ejected by bolt carrier 130. To implement the magazine ejection system of the Headrick disclosure, the user would have to replace several parts, including parts within the AR, making the system too complex for the ordinary gun user. In addition, the Headrick disclosure is not able to detect if the AR has been breached prior to ejecting the spent magazine as required by some states.

Known systems for modifying an AR to automatically eject a spent magazine involved fairly invasive modifications to the AR requiring a high degree of skill to install. Furthermore, known systems do not provide a means for detecting if a weapon has been breached prior to ejecting the magazine as required by certain states.

BRIEF SUMMARY OF THE INVENTION

It is a primary goal of the present invention to facilitate the reloading operation of an AR or one of its many variations.

It is another object of the present invention to facilitate the aforementioned reloading operations by modifying only the magazine and the follower within the magazine.

It is another object of the present invention to require the AR to be breached prior to ejecting the spent magazine.

It is another object of the present invention to reduce the number of steps that a shooter must carry out when undergoing the reloading operation.

It is another object of the present invention to provide an automatic release for the magazine once the last round is removed from the magazine.

It is another object of the present invention to provide an automatic magazine release system that does not rely on gravity to cause the magazine to fall away from the AR.

It is another object of the present invention to provide an automatic magazine release system that can be adapted to a wide range of magazine-fed ARs.

It is a final object of the present invention to provide a magazine release system that allows the shooter to continue to track a target.

These and other goals and objects of the present invention are achieved by a magazine configured for ARs designed to receive magazines, where an AR has a magazine catch to hold the magazine within the AR. The magazine having an outer casing, a follower within the outer casing, and a spring biasing the follower upwards. The casing having an opening, known as a port, in the sidewall of the casing, where the port is positioned to align with the magazine catch in the AR. The follower includes a spring-driven lever activated roller that may extend through the port when the follower reaches a predetermined position within the casing. The roller being in a disengaged mode while the follower is not in the predetermined position within the casing and the roller being in an engaged mode when it is in the predetermined position. While the roller is in the disengaged mode it rolls along the inner wall of the casing to minimize friction between the follower and the casing as well as minimizing wear of the roller. When the roller enters the engaged mode the spring connected to the roller's axle by a lever action causes the roller to enter the port and force the magazine catch release out of the port thus allowing the magazine to fall away from the AR.

Another embodiment of the present invention includes a vertical rod within the follower with the base of the rod being adjacent to the axle of the roller and the top of the rod extending above the follower. A spring about the rod biases the rod upward. When the follower is not in the predetermined position within the casing, the base of the rod is slightly above the axle of the roller. When the follower is in the predetermined position within the casing, the top of the rod makes contact with the internal workings of the AR causing the base of the rod to block the axle of the roller from entering the port and preventing the automatic release of the magazine. With the follower remaining in the predetermined position and the shooter breaching the AR, the spring about the rod bias the rod upward thus unblocking movement of the roller into the port. The roller may then enter the port and disengage the catch mechanism to allow the magazine to be detached from the AR.

Another embodiment of the present invention includes, in addition to the follower, an ejection assist mechanism that may be attached by the shooter to the outer wall of the magazine proximate to the AR. The ejection assist mechanism having a vertical rod that is biased in an upwardly direction by a spring such that if the magazine was not held to the AR by the magazine catch, the rod would push the magazine out of the AR. The ejection assist mechanism may be used by the other embodiments to ensure that the magazine is ejected from the AR once the roller forces the magazine catch out of the port.

These and other features and advantages of this invention are described in, or are apparent from, the following detailed description of various exemplary embodiments of the devices and methods according to this invention.

BRIEF DESCRIPTION OF DRAWINGS

The present invention will become more fully understood from the detailed description and accompanying drawings, wherein:

FIG. 1I A shows a sectional view of the decatch roller that engages with the magazine catch mechanism through the window while the decatch roller is not able to enter into the port.

In the figures, directional arrow 1' will indicate the direction towards the front from the perspective of the rear of the object being presented in the figure. Directional arrow 2' will indicate the direction towards the right from the perspective of the rear of the object being presented in the figure.

DETAILED DESCRIPTION OF THE INVENTION

The following description of the preferred embodiment(s) is merely exemplary in nature and is in no way intended to limit the invention, its application, or uses.

There are a number of ARs available in the marketplace worldwide sold to militaries, law enforcement, and civilian gun owners. The most common AR worldwide is the AK-47 Kalashnikov developed in the Soviet Union during the 1940s and is now manufactured by a variety of companies around the world. In the United States, the most common AR is the AR-15 or an AR derived from the AR-15. These ARs account for an estimated 60 percent of all US civilian rifle sales in 2016 according to the National Shooting Sports Foundation. They are popular because they are simple to maintain, easy to operate, and an abundance of kits allows the owner to quickly modify or improve the AR to function in varying environments and fulfill any number of requirements. For the purpose of this disclosure, a semblance of the AR-15 is utilized throughout the figures. However, the modifications and means disclosed herein may be utilized in any AR.

Figure 1:
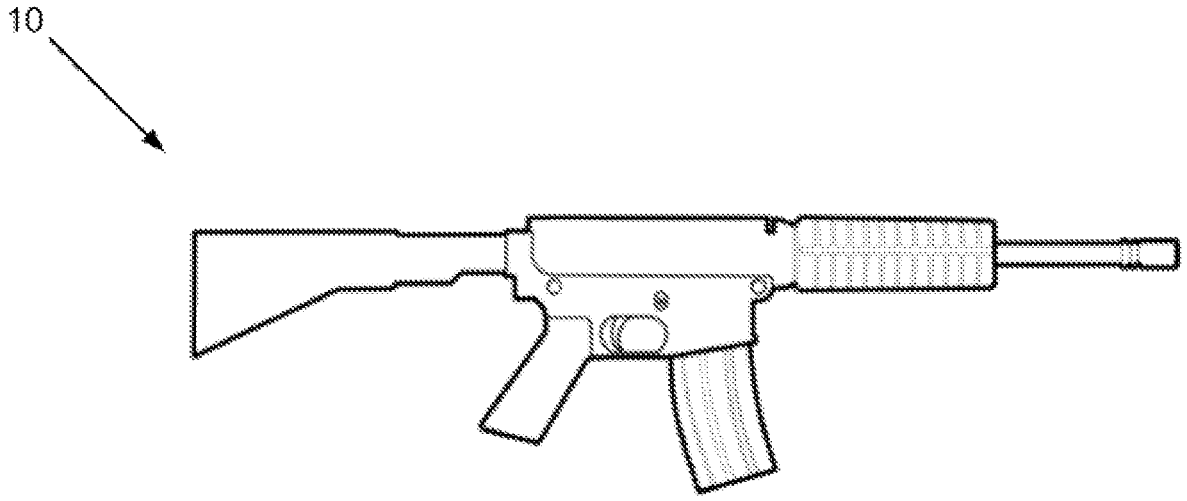
FIG. 1 (Prior Art)
FIG. 1 shows a prior art AR.
Figure 2:
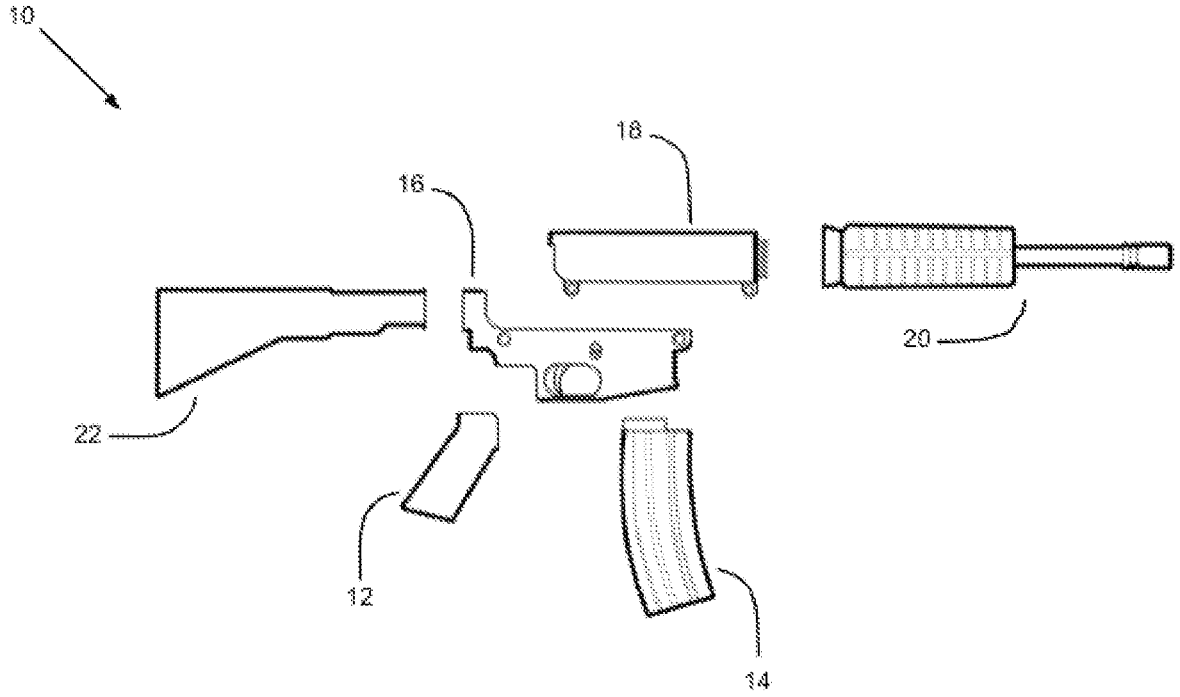
FIG. 2 (Prior Art)
FIG. 2 shows the basic components of a prior art AR.
Figure 3:
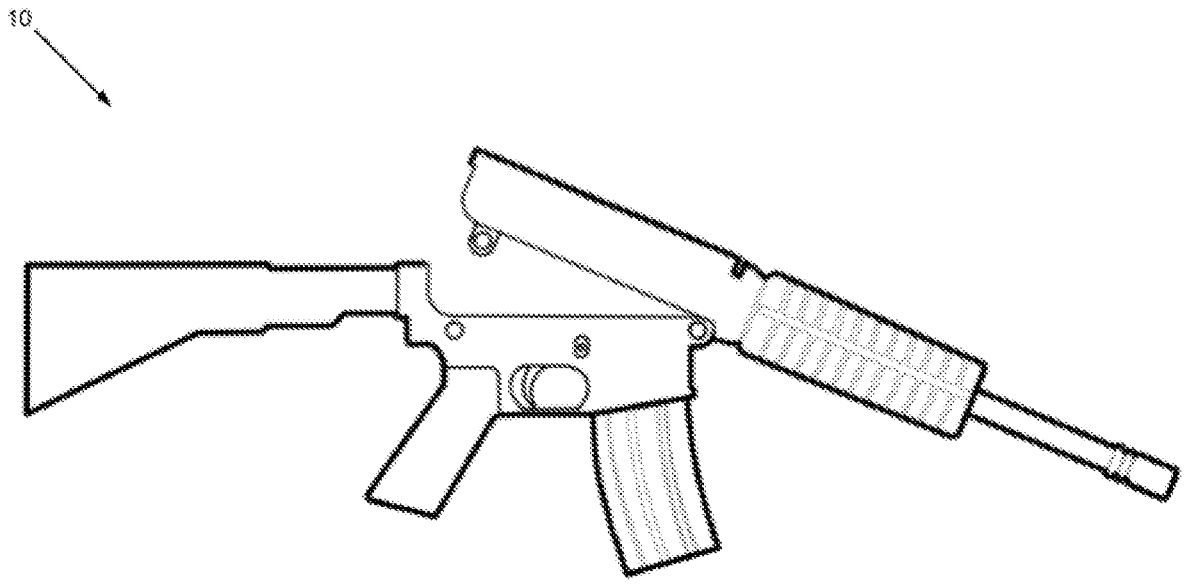
FIG. 3 (Prior Art)
FIG. 3 shows the prior art AR in a "breach" configuration.

FIG. 1 shows a basic assembled and ready to fire AR 10 without any enhancements or accessories such as a carrying strap, scope, bipod, and such. FIG. 2 shows the same basic AR 10 with the major components separated from each other. AR 10 has lower receiver 16 that contains mechanisms for the trigger, hammer, magazine catch, pivot pin, and the takedown pin. Handle 12 is used by the shooter to hold the AR and is adjacent to the trigger in lower receiver 16 to allow access to the trigger by the shooter's index finger. Magazine 14 is used to contain a plurality of rounds and is inserted into and releasably attached to lower receiver 16 by the magazine catch mechanism. Upper receiver 18 contains mechanisms that are used to fire a round through barrel 20 such as the charging handle, bolt carrier and the bolt carrier group, and firing pin. Finally, stock 22 contains the buffer and its associated spring that works with the bolt carrier to fire a round through barrel 20. When assembled, upper receiver 18 and lower receiver 16 may be easily breached at a pivot pin point to allow the shooter to inspect the internals of lower receiver 16 and upper receiver 18 as shown in FIG. 3. In some states, the shooter must breach the AR prior to being able to remove magazine 14. FIG. 3 shows an exceptional degree of breach and this is more for exemplary purposes. A breach sufficient to misalign the bolt carrier within upper receiver 18 and the buffer within stock 22 will satisfy the breaching requirement. This may occur with just a fraction of a degree of separation between upper receiver 18 and lower receiver 16 as the tolerance for alignment of the bolt carrier within upper receiver 18 and the buffer within stock 22 is very small.

Figure 4:
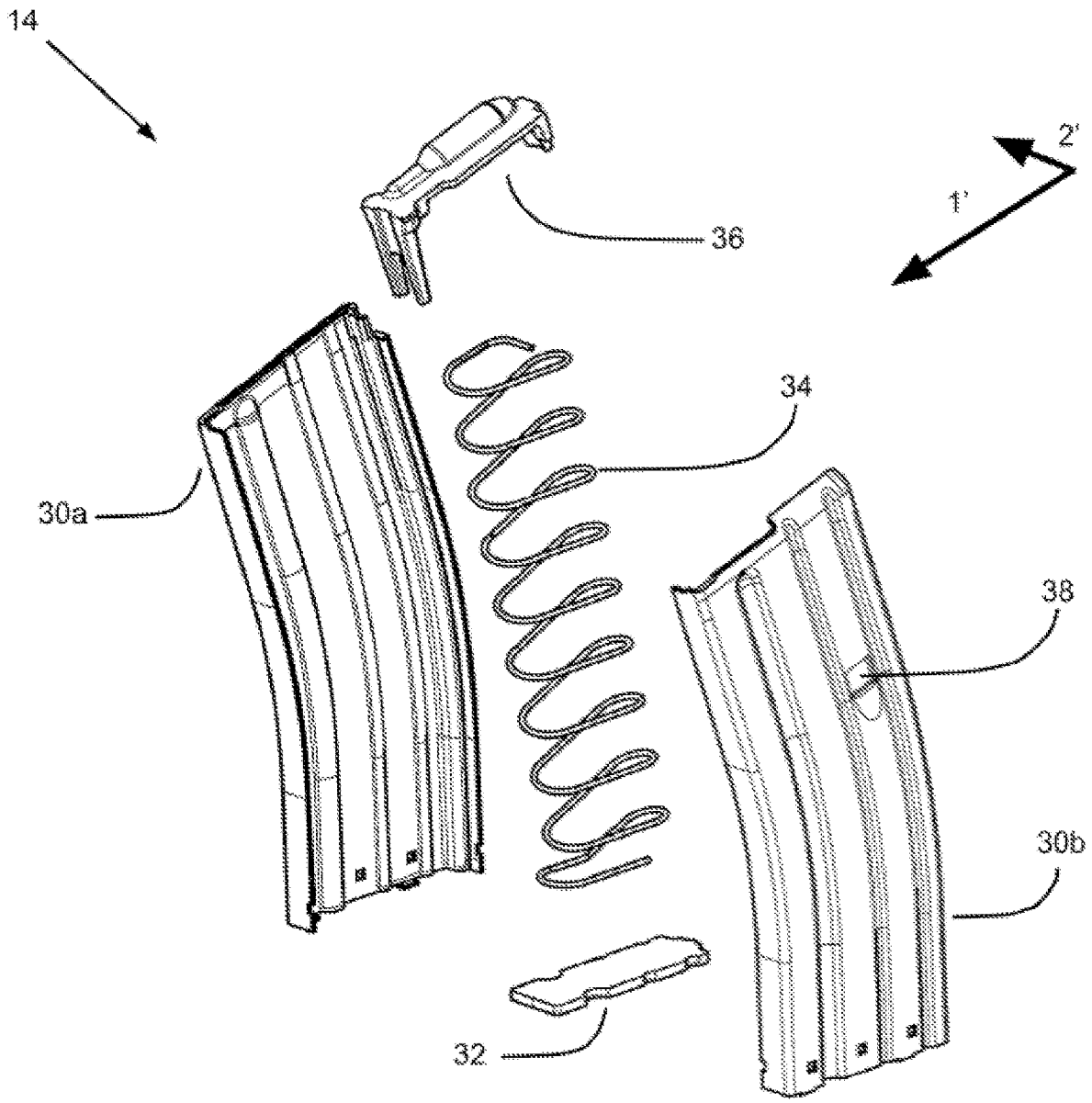
FIG. 4 (Prior Art)
FIG. 4 shows an exploded view of a magazine of the prior art.
Figure 5:
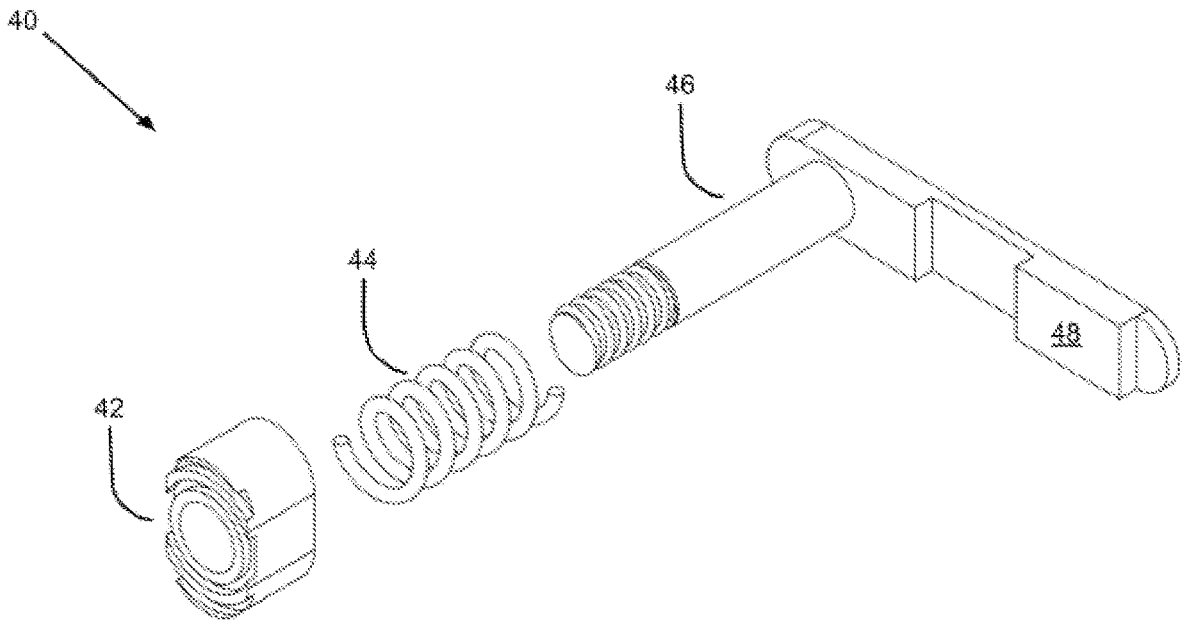
FIG. 5 (Prior Art)
FIG. 5 shows the magazine catch assembly of the prior art.
Figure 6:
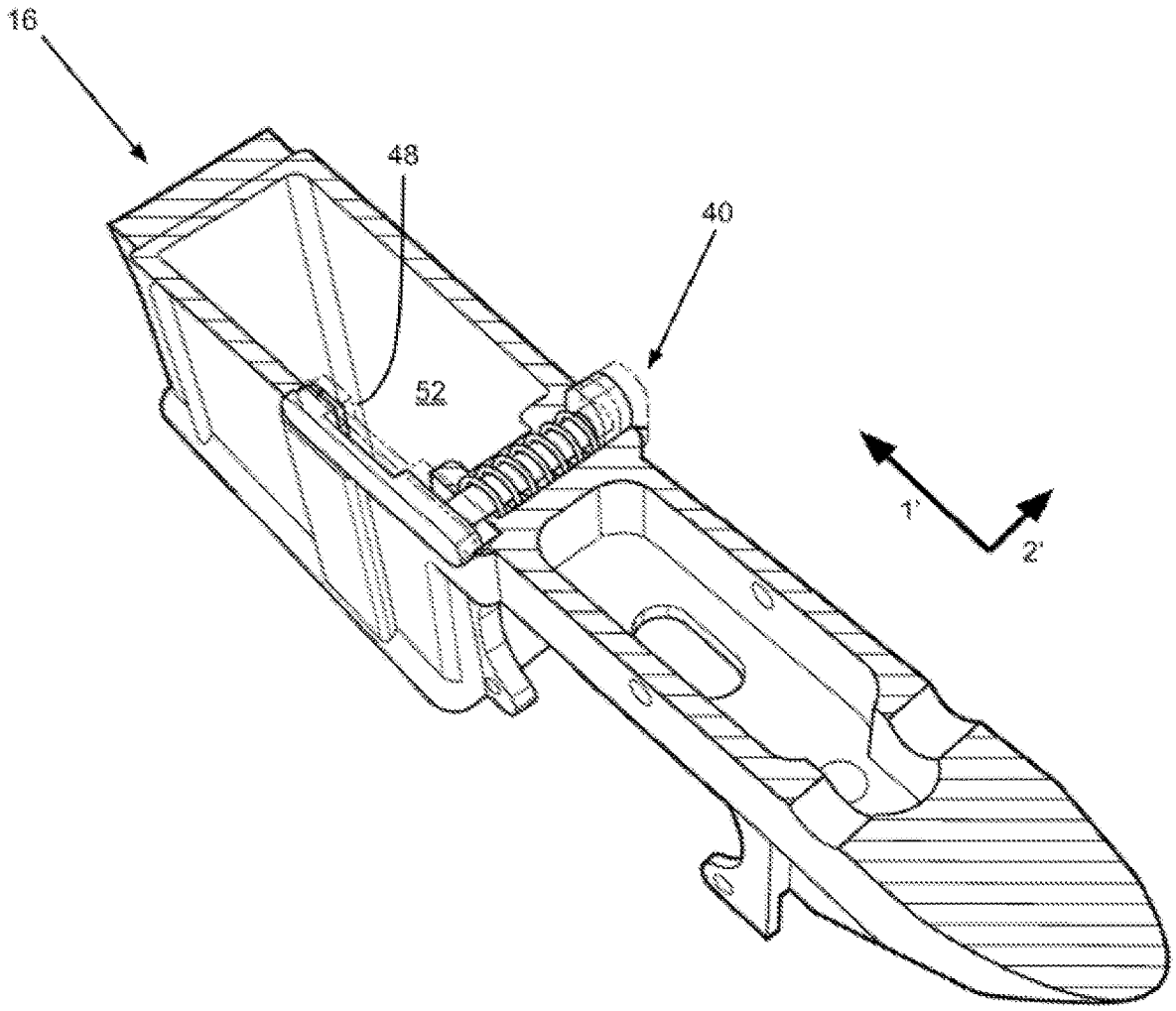
FIG. 6 (Prior Art)
FIG. 6 shows the lower receiver and the range of movement of the magazine catch assembly of the prior art.
Figure 7A:
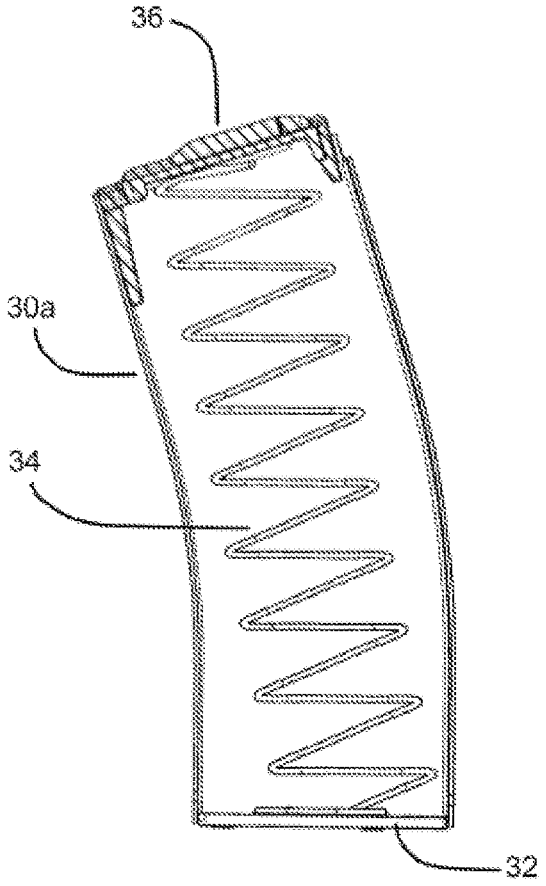
FIG. 7A (Prior Art)
FIG. 7A shows a view of a magazine without any rounds with the left outer casing removed so as to see the internals of the magazine of the prior art.
Figure 7B:
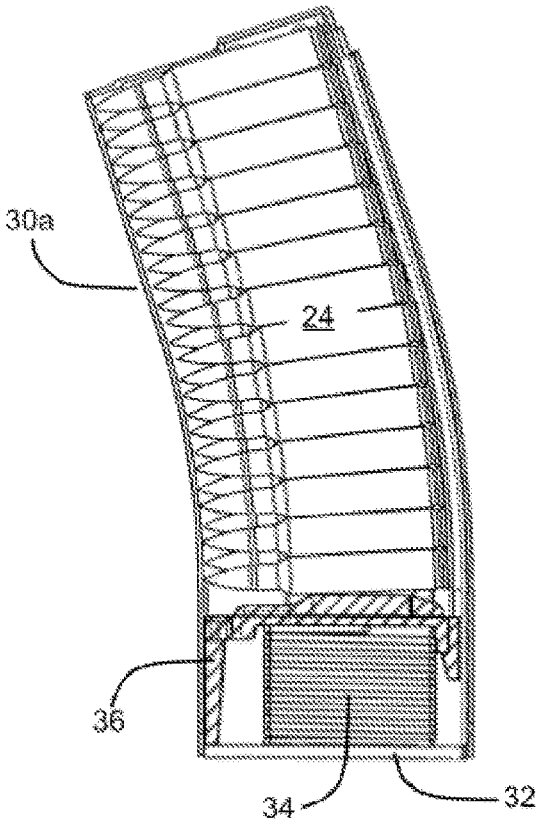
FIG. 7B (Prior Art)
FIG. 7B shows a view of a magazine loaded with rounds with the left outer casing removed so as to see the internals of the magazine of the prior art.

FIG. 4 shows an exploded view of magazine 14 with 1' indicating the direction towards the front. The outer casing 30 is divided into right half 30*a* and left half 30*b*. Between the two casing halves is base 32, spring 34, and follower 36. Base 32 is affixed to the lower edges of outer casing 30 and serves to support spring 34. Spring 34 bias follower 36 upward. Flanges at the top of outer casing 30 prevent follower 36 from being ejected by spring 34 out of magazine 14. To engage with projection 48 in magazine catch assembly 40 shown on FIG. 5, magazine 14 contains window 38. Magazine catch assembly 40 straddles lower receiver 16 as shown in FIG. 6 and consists of three components shown in FIG. 5: button 42 which protrudes from the right side of lower receiver 16; spring 44 which biases button 42 to protrude from the right side of lower receiver 16; and catch 46 which is threadably attached to button 42. When magazine 14 is inserted into magazine well 52, projection 48 is pushed out of the magazine well 52 by the flanges at the top of outer casing 30 once the shooter overcomes the resistive forces provided by spring 44. As magazine 14 continues to be inserted into magazine well 52, projection 48 will remain outside of magazine well 52 until opposite of window 38. At this time, projection 48 will enter window 38 by the action of spring 44 to secure magazine 14 to lower receiver 16. To remove magazine 14 from lower receiver 16, the shooter will exert a force on button 42 sufficient to overcome resistive fibres provided by spring 44 to move button 42 inward toward lower receiver 16. When button 42 moves inward toward lower receiver 16, catch 46 moves away from lower receiver 16 along with projection 48. Once projection 48 has been moved out of magazine well 52, the shooter may remove magazine 14. The range of movement by magazine catch assembly 40 is shown in FIG. 6 and is minimal. The solid outline of magazine catch assembly 40 shows the leftmost position of magazine catch assembly 40 and the dot-dash lines of magazine catch assembly 40 shows the rightmost position of magazine catch assembly 40. When magazine 14 is spent, that is there are no rounds remaining in magazine 14, follower 36 is positioned at the top of magazine 14 as shown in FIG. 7A. When magazine 14 is completely full of rounds then follower 36 is positioned at the bottom of magazine 14 as shown in FIG. 7B. Both FIGS. 7A and 7B show magazine 14 without left half 30*b* in order to see the internal arrangement of spring 34, follower 36, and rounds 24 when magazine 14 is empty and full. As rounds 24 are removed from magazine 14 to replace a round that has just been fired, follower 36 is moved upwards due to biasing of spring 34.

The disclosure up to this point has discussed the prior art as to magazines and followers in particular. As discussed above, in the background of the invention, the problem to be solved is the automatic ejection of a magazine once the last round has been removed from the magazine. In the prior art, to remove a spent, magazine the shooter must with one hand inwardly engage button 42 and with the other hand physically remove magazine 14 from lower receiver 16. This is difficult to accomplish if the shooter wishes to continue to visually track the target. In the preferred embodiment of the present invention, modifications are made solely to the follower so that once the final round has been removed from the magazine, the magazine will automatically disengage from the lower receiver.

Figure 8:
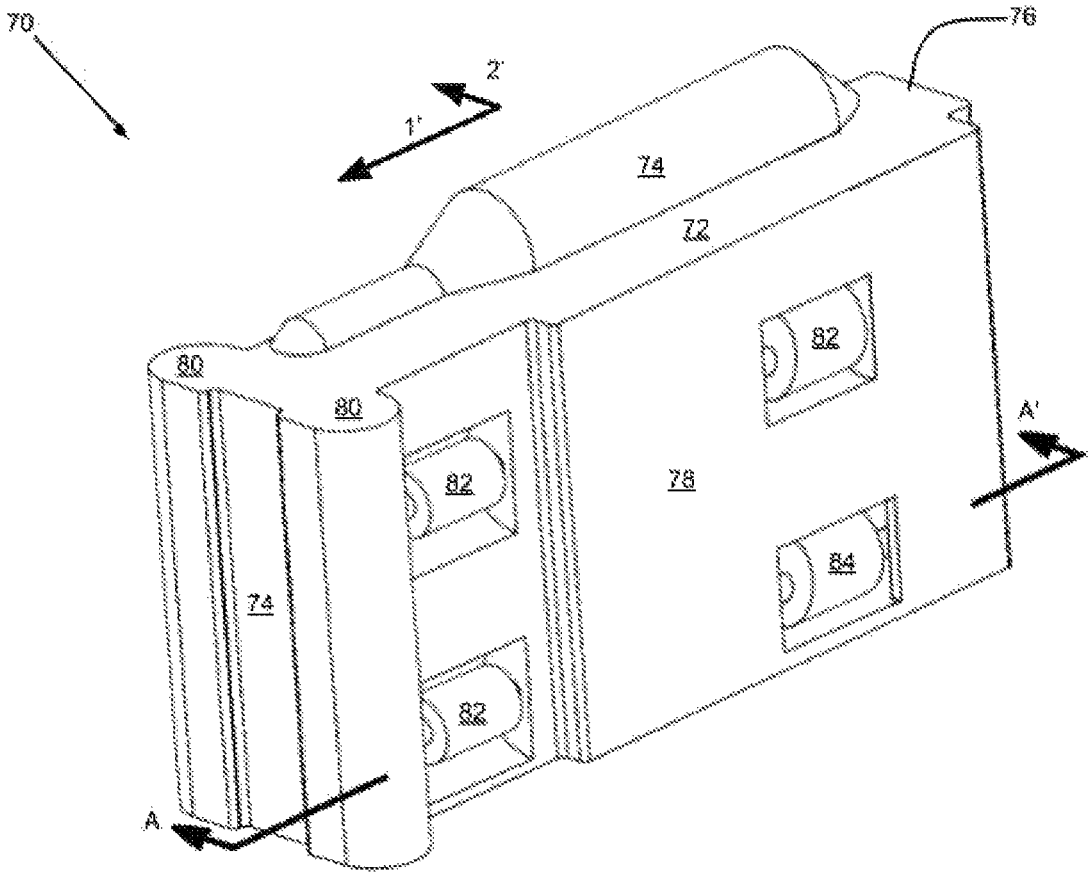
FIG. 8 shows an isometric view of the preferred embodiment of the follower of the present invention.

FIG. 8 shows an isometric view of the preferred embodiment of follower 70 of the present invention. Follower 70 is roughly in the shape of a cuboid with a height, length, and width. The back, side, and front surfaces of follower 70 are irregular in order to match the irregular surfaces of magazine 14 outer casing 30. Generally, a follower will have zero or more back spacers 76, side spacers 78, and front spacers 80 so as to fit into and slide within magazine 14. Rounds 24 are inserted into magazine 14 in a double column where the columns are vertically offset by the radius of the rounds being used as shown in FIG. 7B. Offset spacer 74, of a height equal to the radius of the rounds being used, facilitates this arrangement of the rounds within magazine 14. To minimize the amount of friction between the surfaces of follower 70 and the inner walls of outer casing 30, follower 70 may be equipped with rollers. In the preferred embodiment shown in FIG. 8, there are eight rollers, four on the left side and four on the right side. The rollers on the right side are not visible in FIG. 8 but are arranged in the same manner as the rollers on the left side. Rollers 82 simply rotate about their axles while decatch roller 84 not only rotates about its axle, but may move to protrude outside of the body of follower 70. There is only one decatch roller 84 in follower 70 and it is positioned as shown in FIG. 8, in the lower rearward quadrant of the left side of follower 70.

Figure 9A:
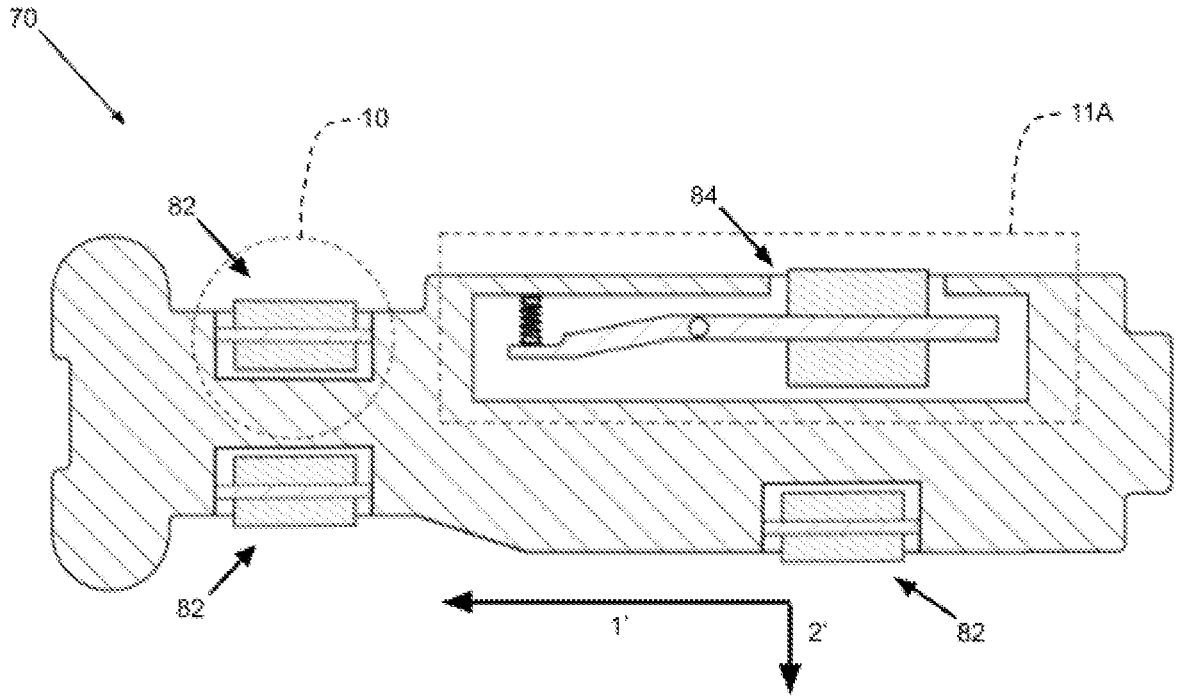
FIG. 9A shows a sectional view of the bottom of the preferred embodiment of the follower when the follower is not opposite the window.
Figure 9B:
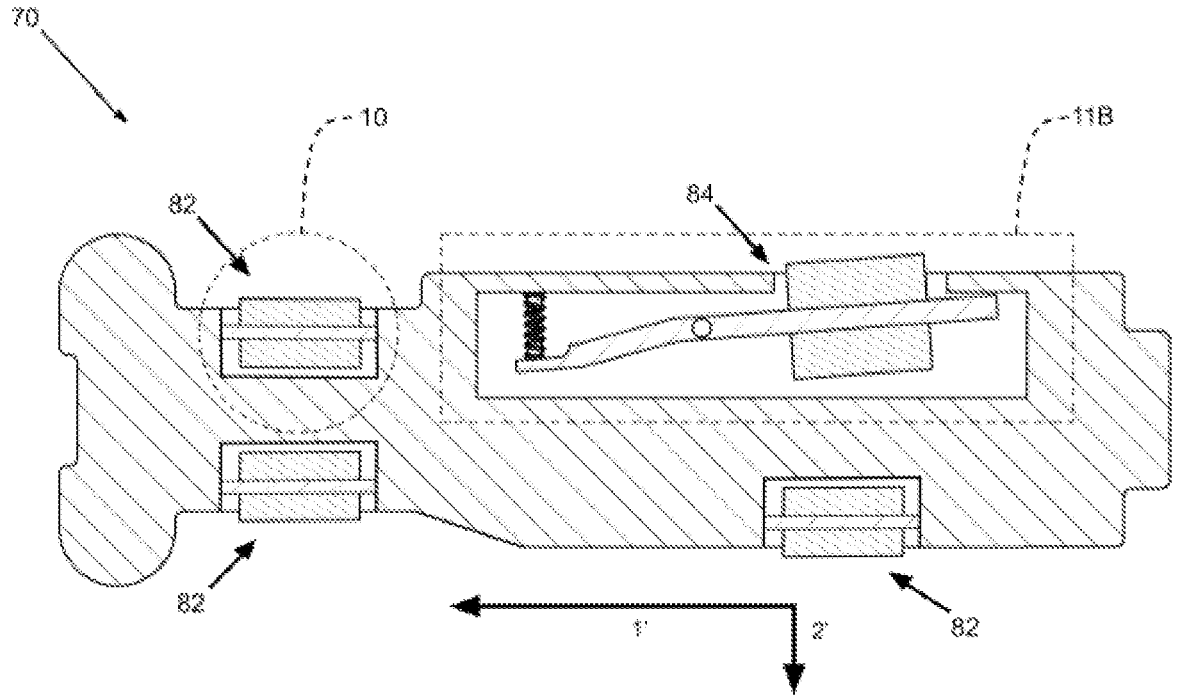
FIG. 9B shows a sectional view of the bottom of the preferred embodiment of the follower when the follower is opposite the window.

FIGS. 9A and 9B both show a bottom sectional view of follower 70 along the sectional line A-A' of FIG. 8. These two figures illustrate the range of motion of decatch roller 84 by axle-lever 112 as well as the construction of rollers 82 and decatch roller 84.

Figure 10:
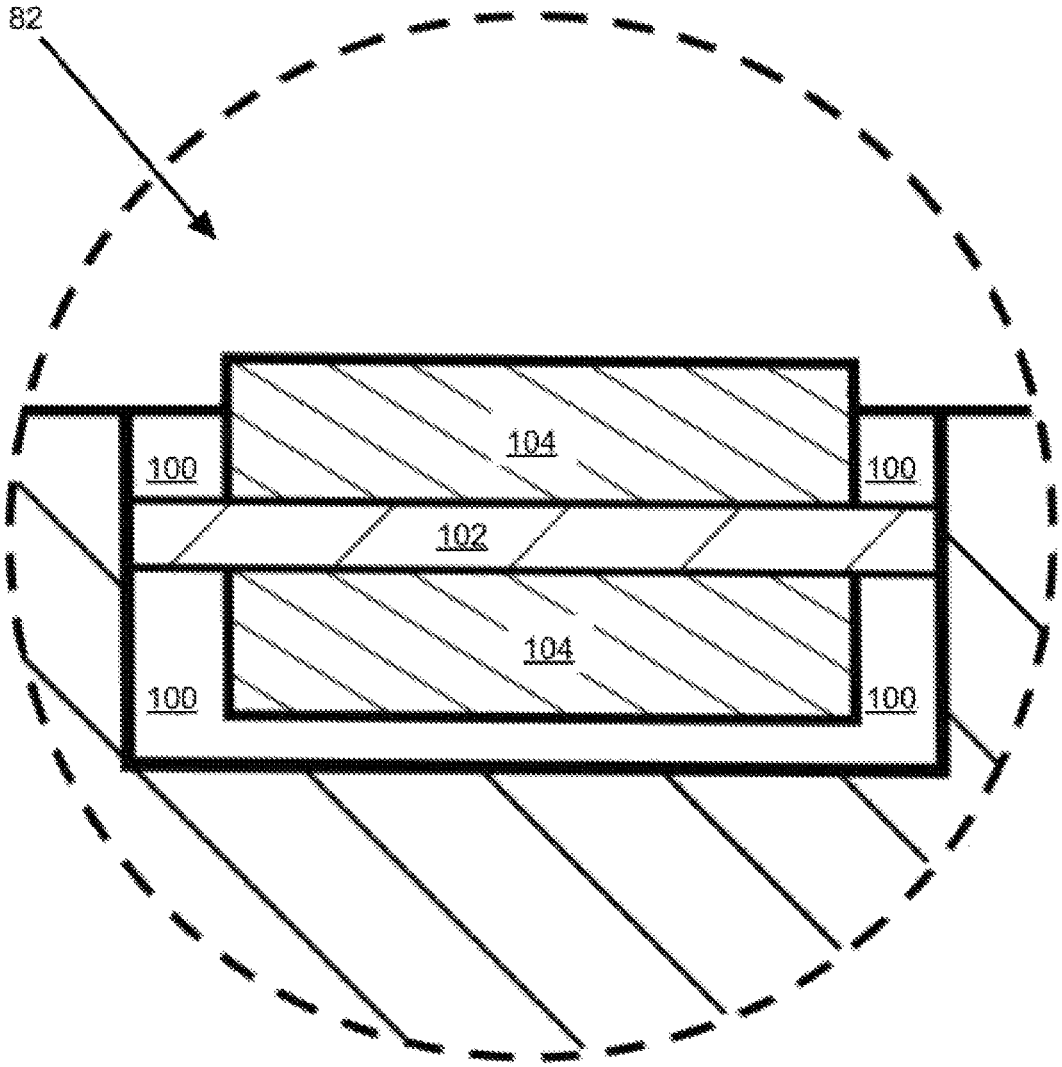
FIG. 10 shows a sectional view of one of the rollers.
Figure 12A:
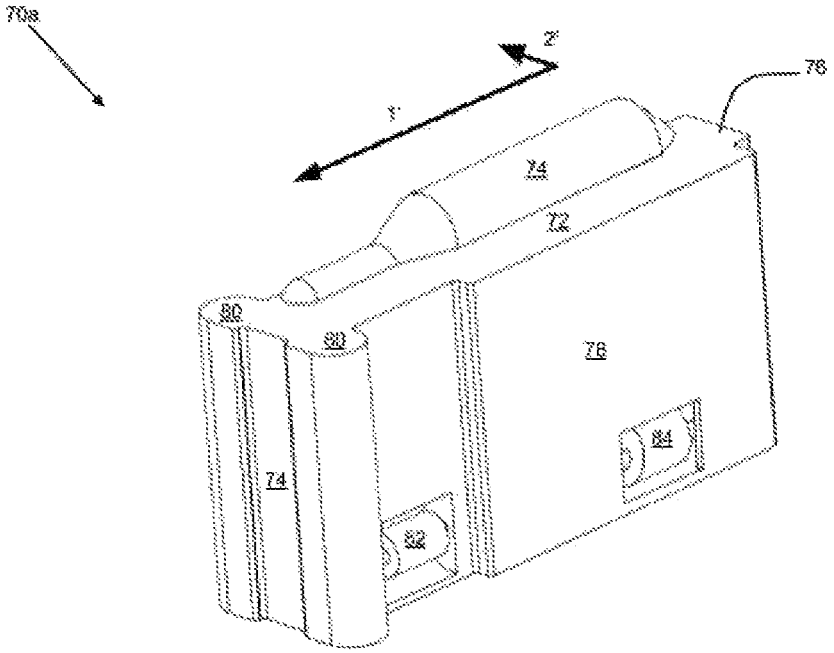
FIG. 12A shows an isometric view of a first alternate embodiment of the follower of the present invention.
Figure 12B:
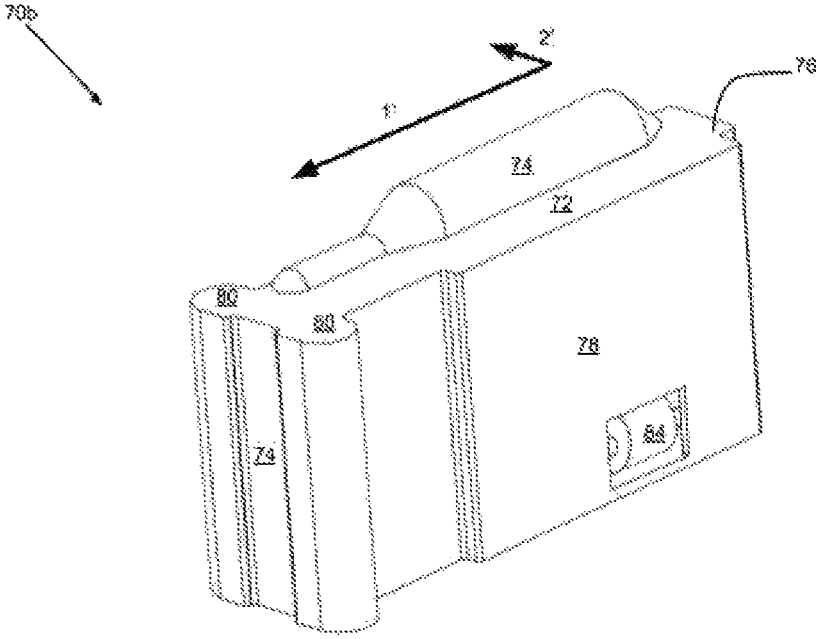
FIG. 12B shows an isometric view of a second alternate embodiment of the follower of the present invention.

Rollers 82, as shown in the partial view of FIG. 10, are comprised of a wheel 104 turning about axle 102. Both wheel 104 and axle 102 are set within enclosure 100. The purpose of rollers 82 is to minimize the amount of friction between follower 70 and the inner wall of outer casing 30 as follower 70 moves up magazine 14 when rounds 24 are removed from magazine 14 and as follower 70 moves down magazine 14 when rounds 24 are inserted into magazine 14. FIG. 8 shows follower 70 with three rollers 82 positioned on its left side. Not shown in FIG. 8 are four rollers 82 positioned on its right side in an arrangement similar to rollers 82 and decatch roller 84 on its left side. Follower 70 may have different arrangements of rollers 82 as shown in FIGS. 12A and 12B. FIG. 12A shows follower 70*a* with one roller 82 on its left side and, although not shown, two rollers 82 on its right side in an arrangement similar to roller 82 and decatch roller 84 on its left side. FIG. 12B shows follower 70*b* in its simplest embodiment without any rollers 82 and only decatch roller 84. Although follower 70*b* will exhibit a greater degree of friction than follower 70*a*, it will be easier to manufacture and its lower cost may be appealing to some shooters.

Figure 11A:
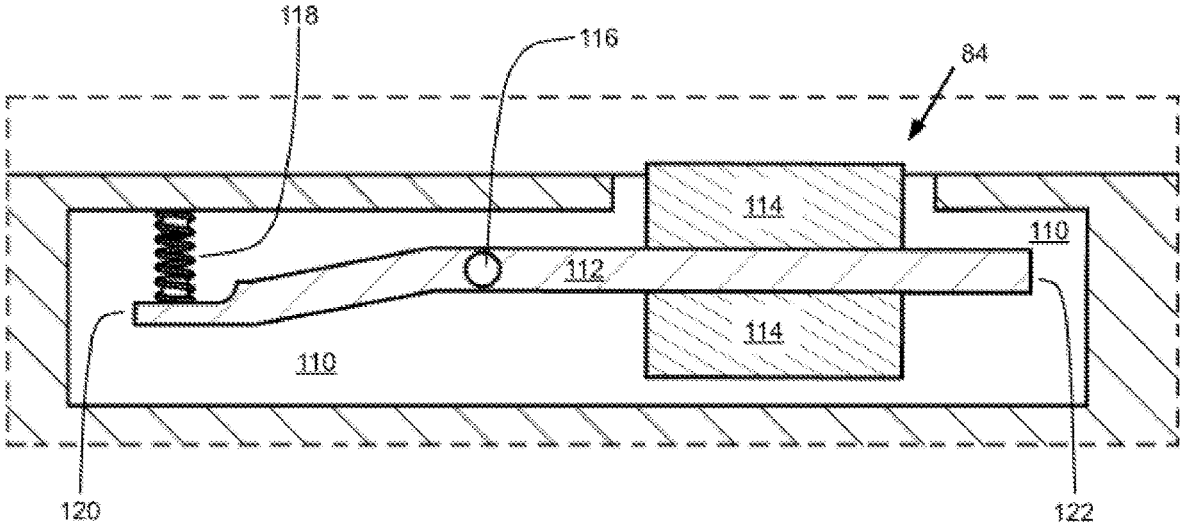
FIG. 11B shows a sectional view of the decatch roller that engages with the magazine catch mechanism through the window while the decatch roller is not able to enter into the port.
Figure 11B:
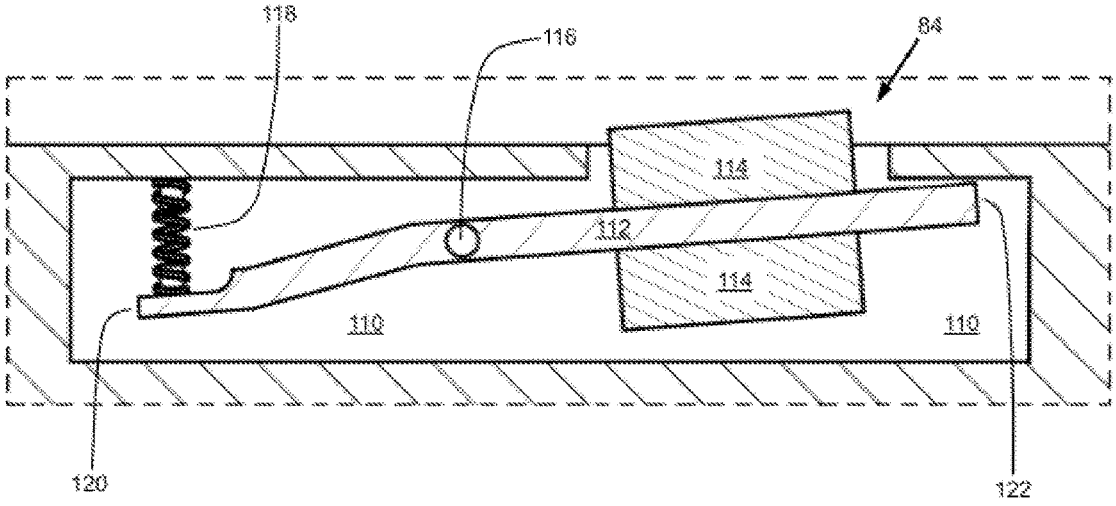

Decatch roller 84, as shown in the partial view of FIG. 11, is similar to roller 82 in that it has wheel 114 that rotates about axle-lever 112 within enclosure 110. Beyond this similarity, decatch roller 84 axle-lever 112 pivots about fulcrum 116 as shown in FIG. 11 to cause wheel 114 to protrude to a greater or lesser extent outside of follower 70. If nothing is present to resist the protrusion of wheel 114 then spring 118 will cause axle-lever to pivot as shown in FIG. 9B. If magazine 14 is empty and not in magazine well 52, decatch roller 84 will be within window 38 and protrude therethrough as shown in FIG. 9B. As rounds are inserted into magazine 14 by the shooter, the downward force created by the inserted round 24 on follower 70 will overcome the force of spring 118 and cause wheel 114 to roll out of window 38 and rest against the inner wall of outer casing 30 as shown in FIG. 9A. As additional rounds 24 are added to magazine 14, follower 70 will continue its downward path with wheel 114 rolling along the inner wall of outer casing 30 as shown in FIG. 9A. Although spring 118 is biasing axle-lever 112 to pivot and thereby acting to protrude wheel 114, the inner wall of outer casing 30 prevents that action. As the shooter inserts magazine 14 containing one or more rounds 24 into magazine well 52, eventually window 38 will engage magazine catch assembly 40 in lower receiver 16 and projection 48 of catch 46 will enter window 38 by action of spring 44 and thus releasably attach magazine 14 to AR 10. By pressing button 42 with one hand the shooter may cause projection 48 to exit window 38 and thus allowing for the removal of magazine 14 from magazine well 52. Projection 48 may also be disengaged from window 38 by wheel 114 as follows. As round 24 is removed from magazine 14 to replace a recently fired round, follower 70 will travel upward through magazine 14 with wheel 114 positioned as shown in FIG. 9A. When the last round has been removed from magazine 14, follower 70 will be at the top of magazine 14 and decatch roller 84 will be opposite window 38 which is occupied by projection 48. In such a situation, wheel 114, by the force of spring 118 acting on axle-lever 112 and magnified by the lever action of fulcrum 116, overcomes the action of spring 44 and pivots as shown in FIG. 9B to push projection 48 out of window 38. Once projection 48 is out of window 38, magazine 14 may be removed from magazine well 52 by the shooter with just a single hand while allowing the shooter to retain visual contact with the target.

Figure 13:
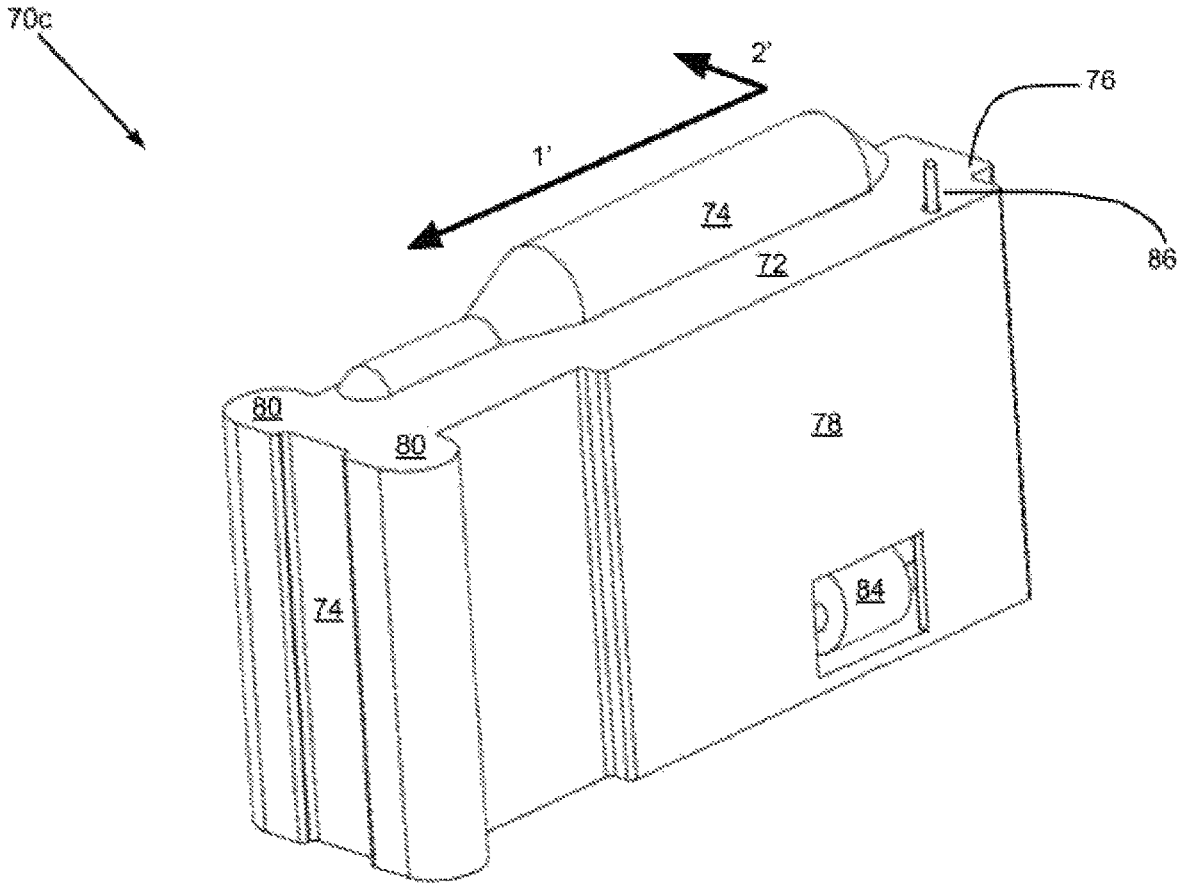
FIG. 13 shows an isometric view of a third alternate embodiment of the follower of the present invention.
Figure 14:
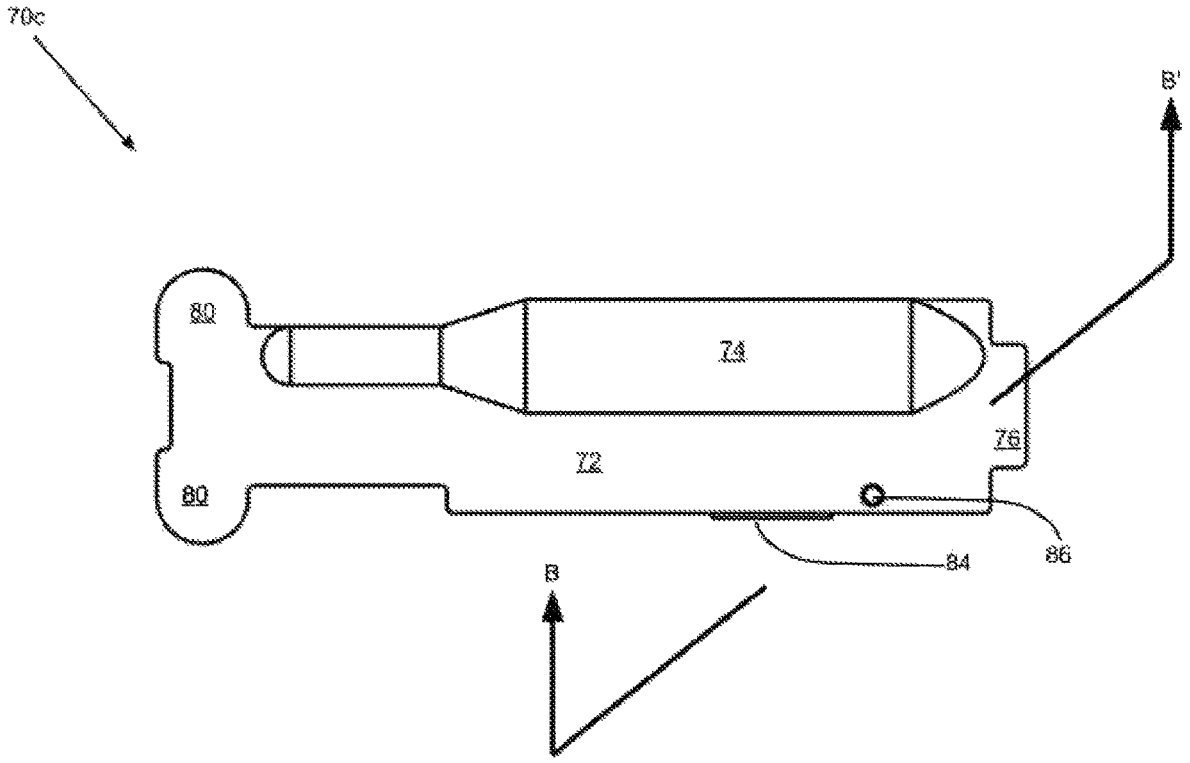
FIG. 14 shows a top view of the third embodiment of the follower of the present invention.
Figure 15A:
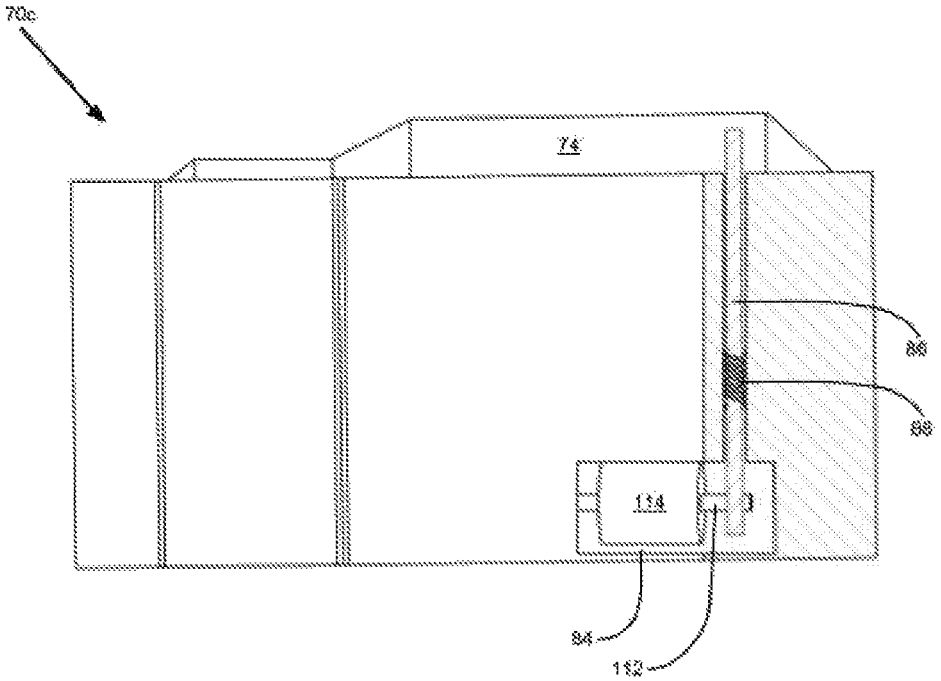
FIG. 15A shows a sectional view of the third embodiment of the follower of the present invention with the breach detection rod in the lowered position.
Figure 15B:
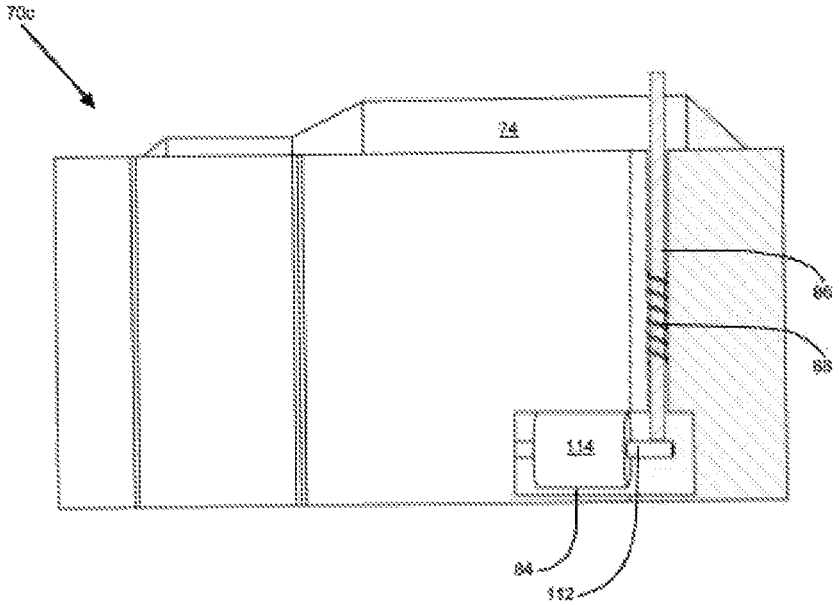
FIG. 15B shows a sectional view of the third embodiment of the follower of the present invention with the breach detection rod in the raised position.

In certain states of the United States, an AR must be breached as shown in FIG. 3 in order to remove a spent magazine. As stated earlier, a breach sufficient to misalign the bolt carrier within upper receiver 18 and the buffer within stock 22 will satisfy the breaching requirement. The follower of the present disclosure may be modified to further include a breach detection mechanism to detect a breached condition and thus allow wheel 114 of decatch roller 84 to engage projection 48 for the removal of magazine 14 out of magazine well 52. FIG. 13 shows another embodiment of the follower of the present invention: follower 70*c*. This follower contains a breach detection mechanism, breach detection rod 86 and spring 88, that will detect a breached condition and allow wheel 114 from decatch roller 84 to enter into window 38 to disengage projection 48. FIG. 14 shows a top view of follower 70*c* with breach detection rod 86. FIGS. 15A and 15B show follower 70*c* along the sectional line B-B' of FIG. 14. Breach detection rod 86 is a rod within follower 70*c* positioned vertically between the distal end of axle-lever 112, reference 122 in FIG. 11, and the outer surface of the wall of follower 70*c*. Breach detection rod 86 may move up and down within follower 70*c* but is biased upward by spring 88. When breach detection rod 86 is fully depressed, it will block axle-lever 112 of decatch roller 84 from pivoting and not allow wheel 114 to protrude out of follower 70*c*. When breach detection rod 86 is biased upwards by spring 88, decatch roller 84 will function as shown in FIGS. 9A and 9B and described previously for follower 70. When magazine 14 is fully loaded with rounds 24, follower 70*c* will be found at the bottom of magazine 14. At this position breach detection rod 86 is biased upwards by spring 88 and breach detection rod 86 fully protrudes out of the top of follower 70*c* as shown in FIG. 15B. In addition, Wheel 114 is prevented from protruding out of the follower by the inner wall of outer casing 30. Follower 70*c* will remain in this state as rounds 24 are removed from magazine 14 until a certain number, preferably two, rounds remain in magazine 14. At this point, breach detection rod 86 comes into contact with upper receiver 18. As additional rounds 24 are removed from magazine 14, spring 34 within magazine 14, overcomes the resisting force of spring 88 biasing breach detection rod 86 and the rod begins to be depressed into follower 70*c* as it may no longer move upward being it has come into contact with upper receiver 18. As the last round 24 is removed from magazine 14, breach detection rod is depressed to the point where it will block axle-lever 112 of decatch roller 84 from pivoting wheel 114 into window 38. Thus, even if wheel 114 is opposite window 38, it will not be able to enter into window 38 so as to remove projection 48 of catch 46 from window 38 and release magazine 14 from magazine well 52. This is shown in FIG. 15A. When AR 10 is breached as shown in FIG. 3, upper receiver 18 and lower receiver 16 are separated and spring 88 will bias breach detection rod 86 upward as shown in FIG. 15B. As breach detection rod 86 no longer blocks axle-lever 112 from pivoting, wheel 114 is able to pivot into window 38 and push projection 48 of catch 46 out of window 38 and magazine 14 will no longer be attached to lower receiver 16.

Figure 16:
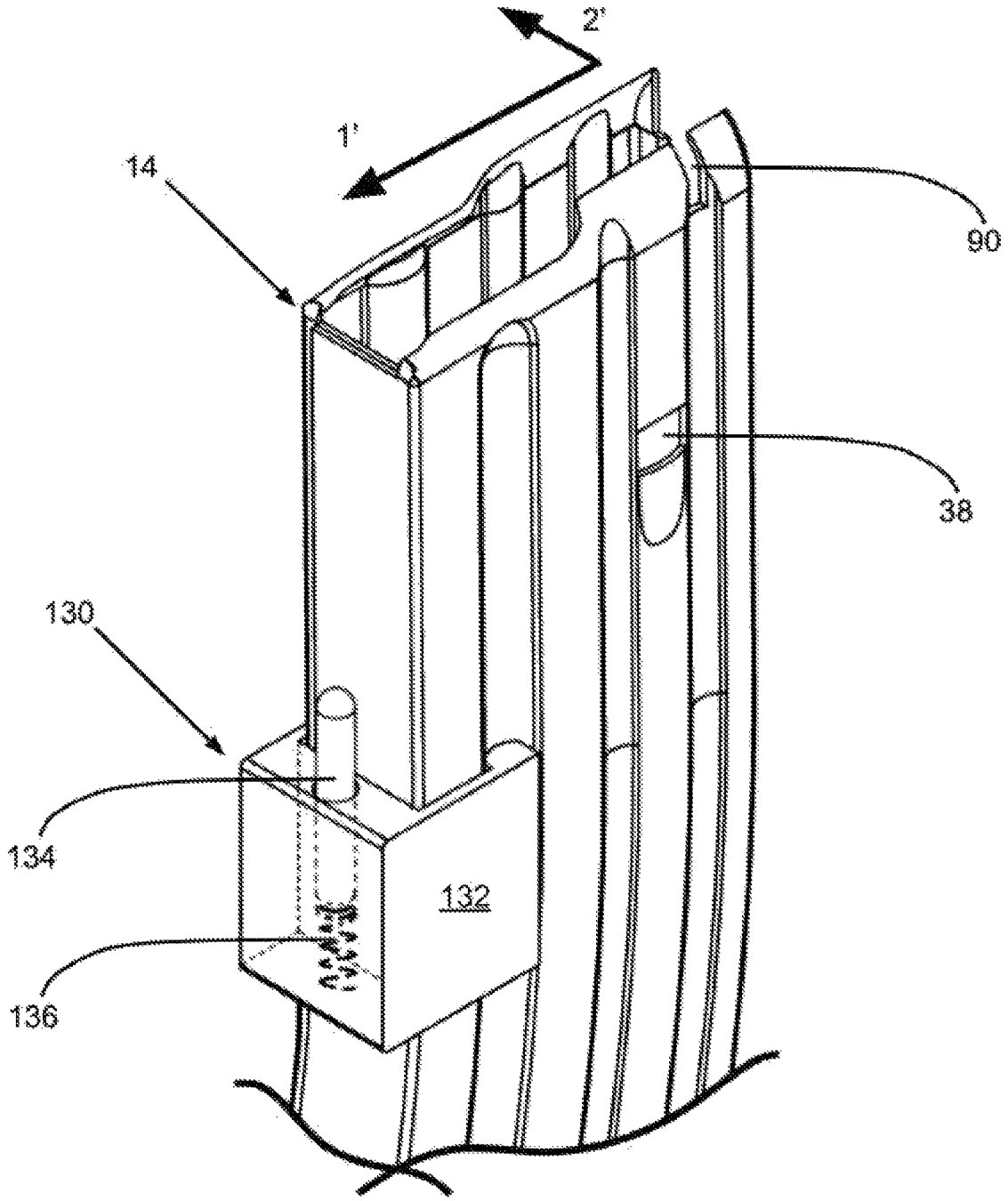
FIG. 16 shows an isometric view of the magazine with the ejector assembly attached thereto.

When using follower 70*c*, magazine 14 must be modified to allow breach detection rod 86 to pass through the flanges at the top of outer casing 30*b*. In order to allow breach detection rod 86 to pass through the flange at the top of outer casing 30*b*, outer casing 30*b* must be modified by the addition of gap 90 as shown in FIG. 16. Then when breach detection rod 86 is fully extended as shown in FIG. 15B, it may pass the flange at the top of outer casing 30*b* to make contact with lower receiver 18.

Figure 17:
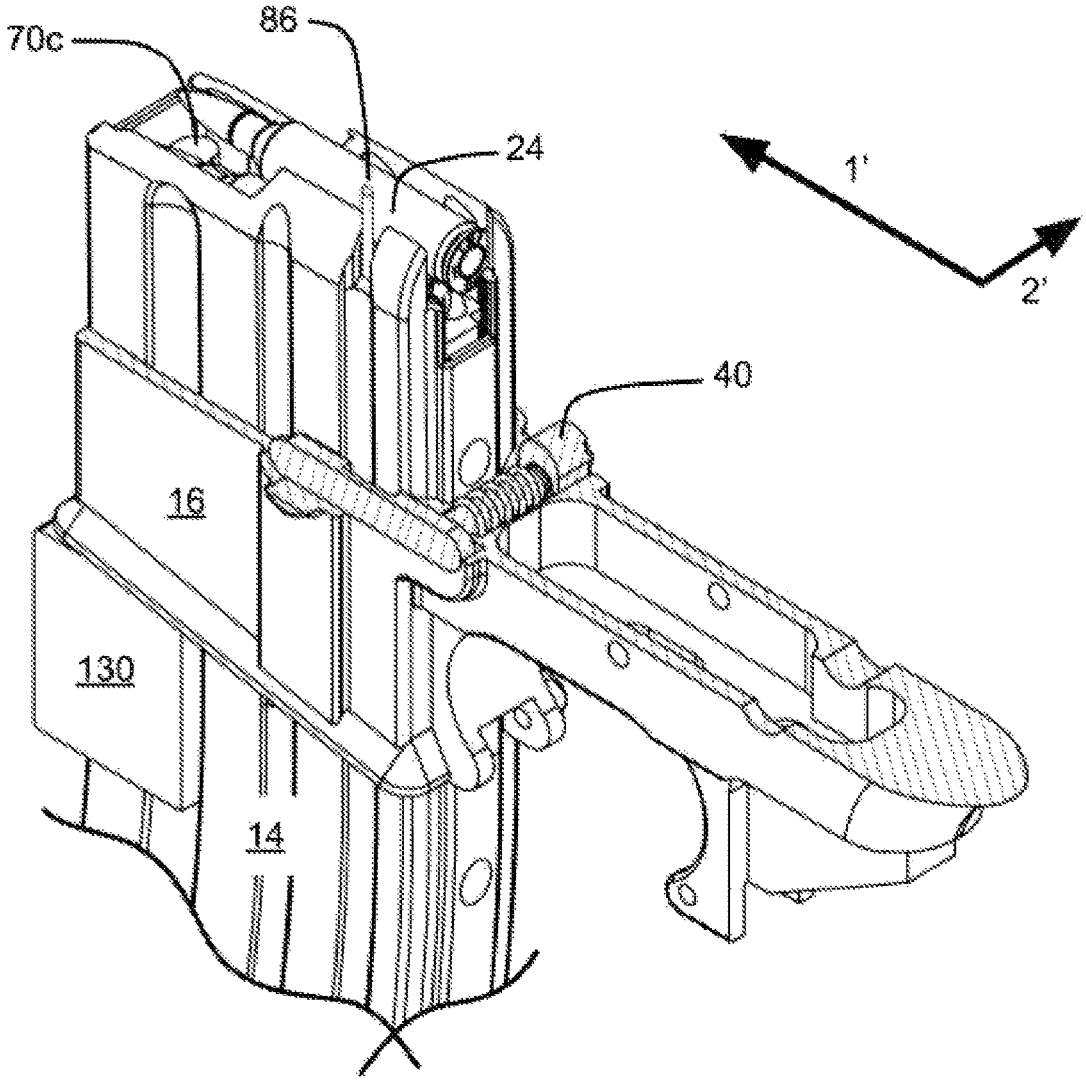
FIG. 17 shows an isometric view of the lower receiver with an inserted magazine having an ejector assembly attached thereto.

It may be desirable to a shooter, to have magazine 14 automatically dropped from magazine well 52 once projection 48 has been removed from window 38 by the pivoting action of spring 118, axle-lever 112, and wheel 114. However, due to the friction between the outer surfaces of magazine 14 and magazine well 52, magazine 14 may remain in magazine well 52 and the shooter will need to manually remove magazine 14 from magazine well 52. To overcome the friction between the outer surfaces of magazine 14 and magazine well 52, magazine 14 may be further modified to include an assembly to assist in ejecting magazine 14. Such an assembly is shown in FIG. 16 as ejector assembly 130. Ejector assembly 130 may be permanently attached to magazine 14 as shown in FIG. 16 or may be releasably attached to magazine 14 using any number of such mechanisms available in the art. Ejector assembly 130 is mounted on the front of magazine 14 and high enough so that when magazine 14 has been inserted into magazine well 52 of lower receiver 16, ejector assembly 130 will be in contact with lower receiver 16 as shown in FIG. 17. Ejector assembly 130 is comprised of housing 132 that contains pin 134 and spring 136 that biases pin 134 upward out of housing 132. When magazine 14 is outside of magazine well 52, pin 134 is fully extended outside of housing 132 by spring 136. When magazine 14 is inserted into magazine well 52, pin 134 is depressed into housing 132 with spring 136 in a state of compression. Although spring 136 is in a state of compression, magazine 14 will remain attached to lower receiver as long as projection 48 is in window 38. Once projection 48 is pushed out of window 38 by the pivoting action of wheel 114 in decatch roller 84, spring 136 will force pin 134 upwards resulting in magazine 14 being ejected from magazine well 52.

Figure 18:
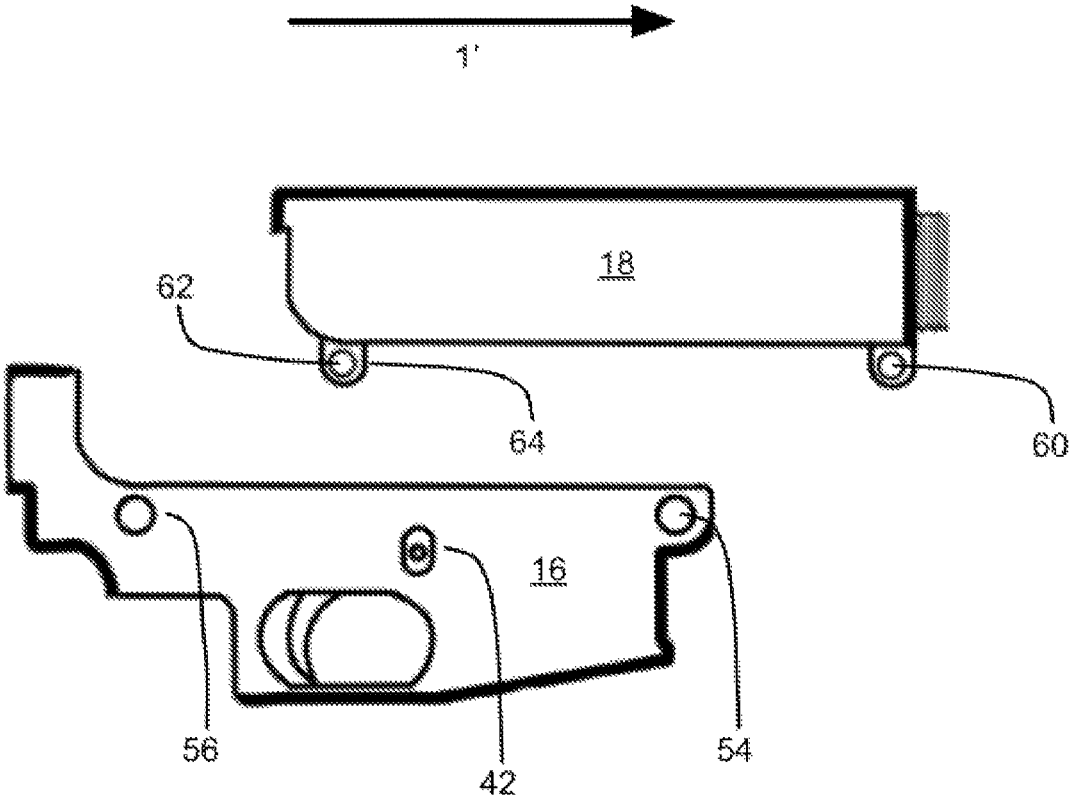
FIG. 18 shows a side view of the upper and lower receiver of an AR.

In order to breach AR 10 the shooter will have to misalign the bolt carrier within upper receiver 18 and the buffer within stock 22 that is connected to lower receiver 16. FIG. 18 shows a detail view of upper receiver 18 and lower receiver 16 to demonstrate how AR 10 is breached. Upper receiver 18 and lower receiver 16 are joined together forwardly by a pin passing through pivot opening 54 and through pivot passage 60 and rearwardly by a pin passing through takedown opening 56 and takedown passage 62. The forward pin is referred to as the pivot pin and the rearward pin is referred to as the takedown pin. To breach AR 10 the shooter will remove the takedown pin and thus uncouple the rearward joinder of upper receiver 18 and lower receiver 16 to allow upper receiver 18 to rotate about the pivot pin. When barrel 20 is attached to upper receiver 18, the unbalanced nature of both upper receiver 18 and barrel 20 about the pivot pin will cause upper receiver 18 to rotate about the pivot pin once the takedown pin has been removed. This is undesirable as AR 10 is now fully breached, unwieldy, and requires additional effort of the part of the shooter to return AR 10 to a condition where it is operational. To prevent AR 10 from becoming fully breached, yet still allowing breach detection rod 86 to detect that the AR has been breached it is desirable to minimize the amount of angular travel that upper receiver 18 may perform.

Figure 19:
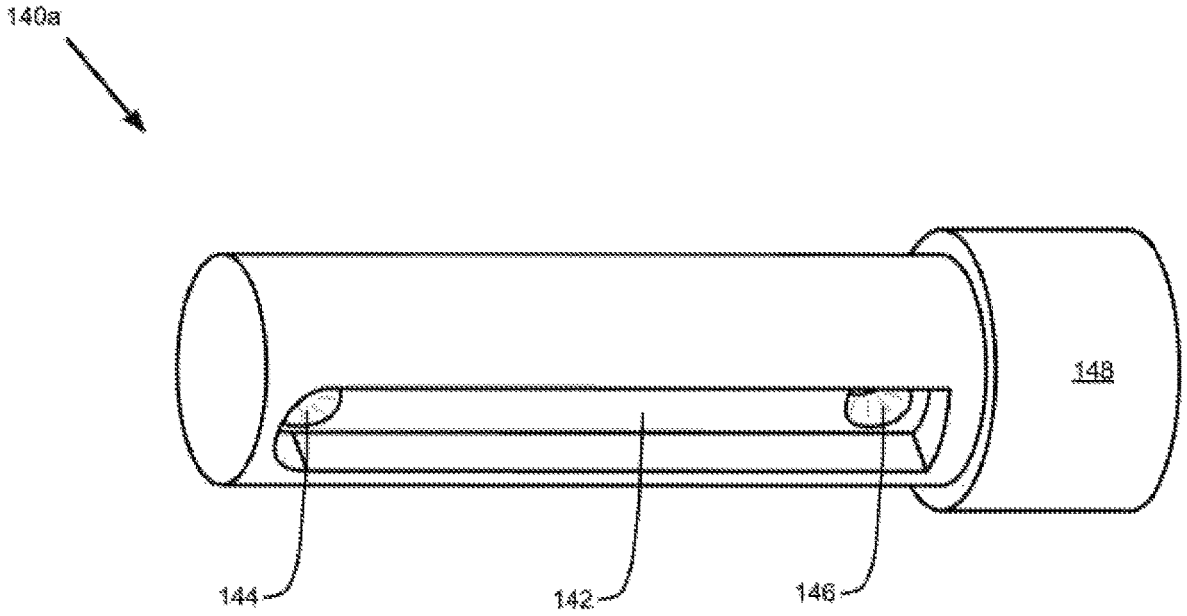
FIG. 19 shows a takedown pin of the prior art.

FIG. 19 shows takedown pin 140*a* of the prior art. Divots 144 and 146 are found on either side of takedown pin 140*a* and are joined by channel 142. Divots 144 and 146 interface with a detent found in lower receiver 16. When takedown pin 140*a* is fully inserted into takedown opening 56 and passes through takedown passage 62, AR 10 is ready to fire as the bolt carrier within upper receiver 18 and the buffer within stock 22 are aligned. When takedown pin 140*a* is fully inserted a detent in lower receiver 16 is engaged with divot 146 to prevent takedown pin 140*a* from being inadvertently removed from takedown passage 62. To breach the AR as shown in FIG. 3, the shooter must pull handle 148 outward so that the detent in lower receiver 16 engages divot 144. To return the AR back to a non-breaching condition the shooter must bring the rear of upper receiver 18 back to the rear of lower receiver 16 so that takedown opening 56 and takedown passage 62 are aligned and then push takedown pin 140*a* into takedown passage 62 so that divot 146 is again engaged with the detent found in lower receiver 16. When the AR has been breached in this manner and barrel 20 is attached to upper receiver 18, the AR will fully breach as the center of gravity of the combination of upper receiver 18 and barrel 20 is forward of pivot opening 54. When fully breached, additional efforts are required by the shooter to return the AR back to a non-breaching condition. To simplify the return of the AR back to a non-breaching condition, takedown pin 140*b* may be used so that the AR will only partially breach.

Figure 20:
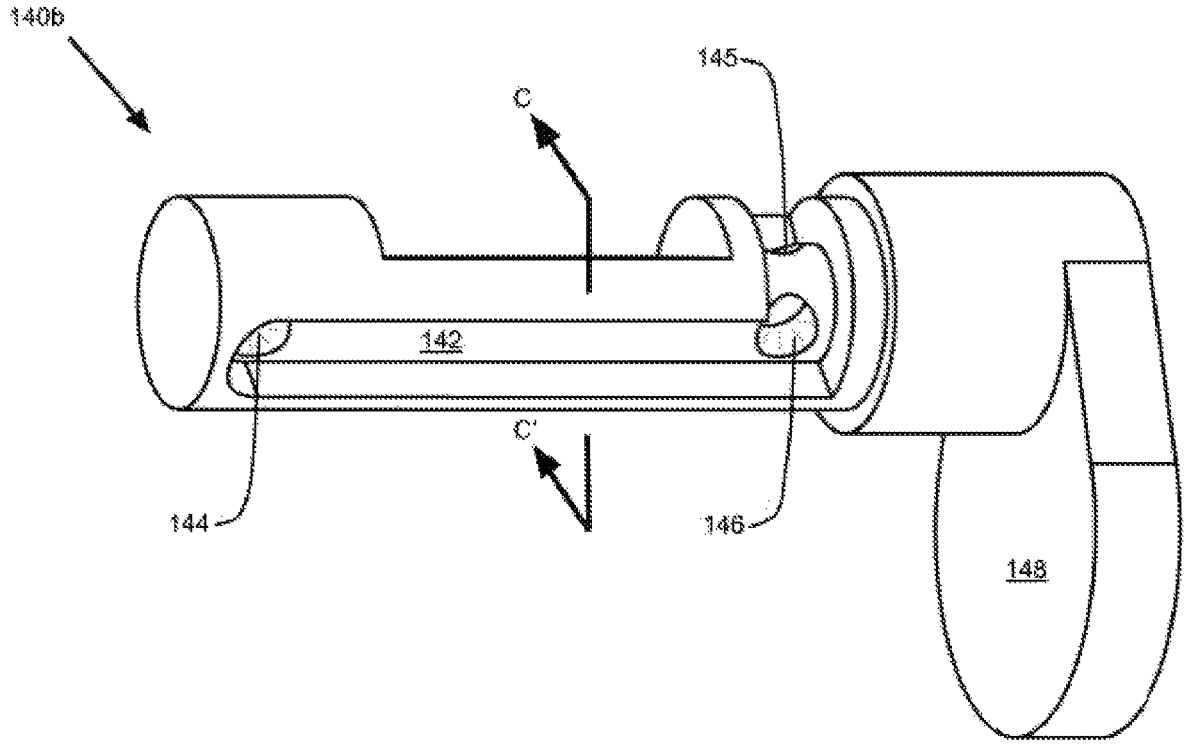
FIG. 20 shows a takedown pin of the present disclosure.

FIG. 20 shows takedown pin 140*b* of the present disclosure. Divots 144 and 146 are found on either side of takedown pin 140*b* and are joined by channel 142 just as in the prior art takedown pin 140*a*. Specific to the takedown pin 140*b* of the present disclosure is a third divot, 145, that is at a 90 degree offset from and connect by a channel to divot 146; a cutout portion along the length of the pin the cutout being longer than takedown passage 62; and an enlarged handle 148 to facilitate changing the divot, 145 or 146, that is engaged by the detent found in lower receiver 16. When the detent found in lower receiver 16 is engaged with divot 144, the AR may be fully breached. When the detent found in lower receiver 16 is engaged with divot 146, the AR is not breached. When the detent found in lower receiver 16 is engaged with divot 145, the AR may be only be partially breached. When the AR is only partially breached, it is only breached enough so that bolt carrier within upper receiver 18 and the buffer within stock 22 are not aligned. As the tolerance of alignment between the bolt carrier within upper receiver 18 and the buffer within stock 22 is tight, a very small amount of angular displacement between upper receiver 18 and lower receiver 16 is sufficient to breach the AR. This partial breaching condition is demonstrated in FIGS. 21 and 22.

Figure 21:
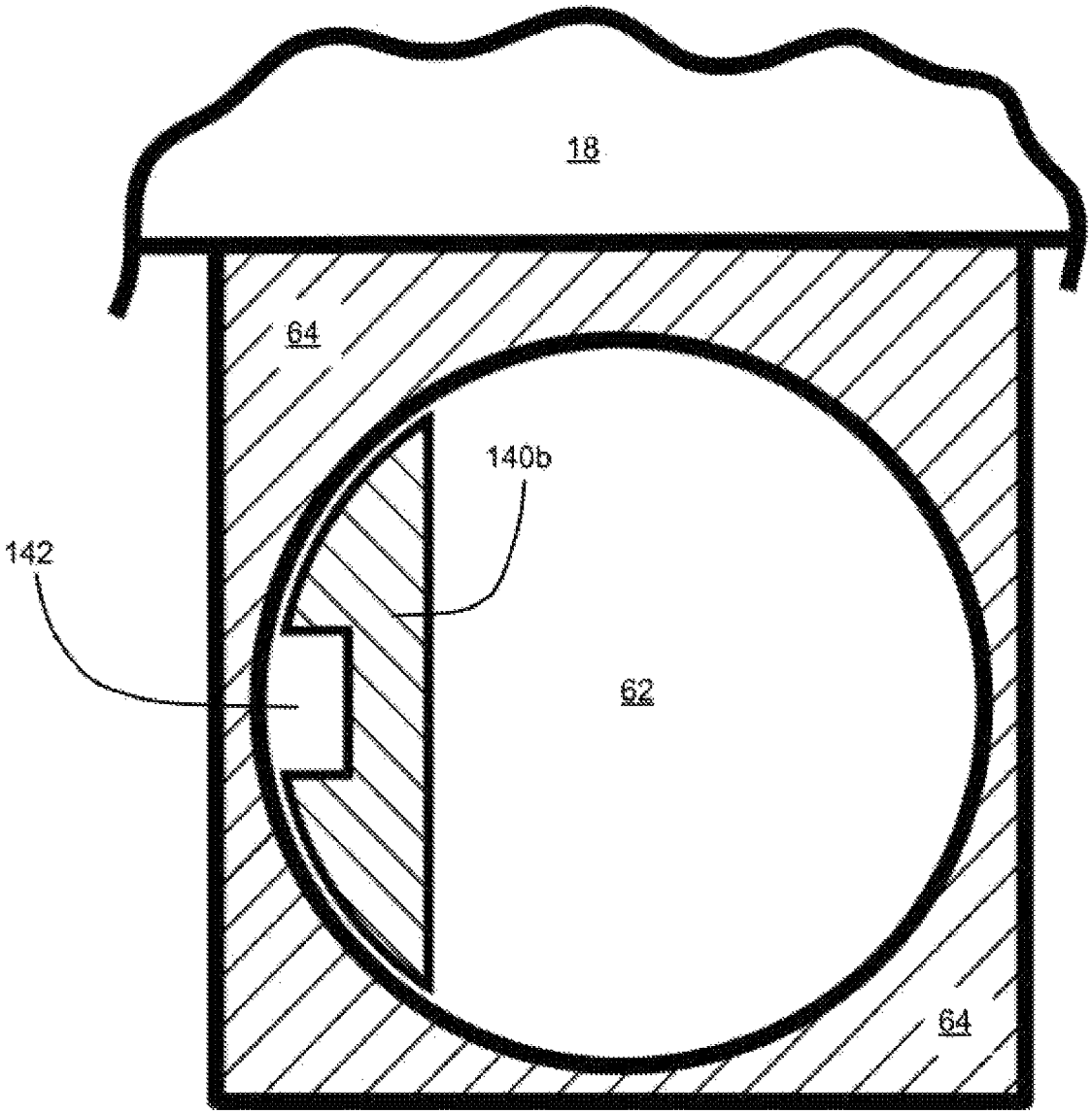
FIG. 21 shows a sectional view of the takedown pin of the present disclosure within the passage found in the upper receiver when the AR is branched.
Figure 22:
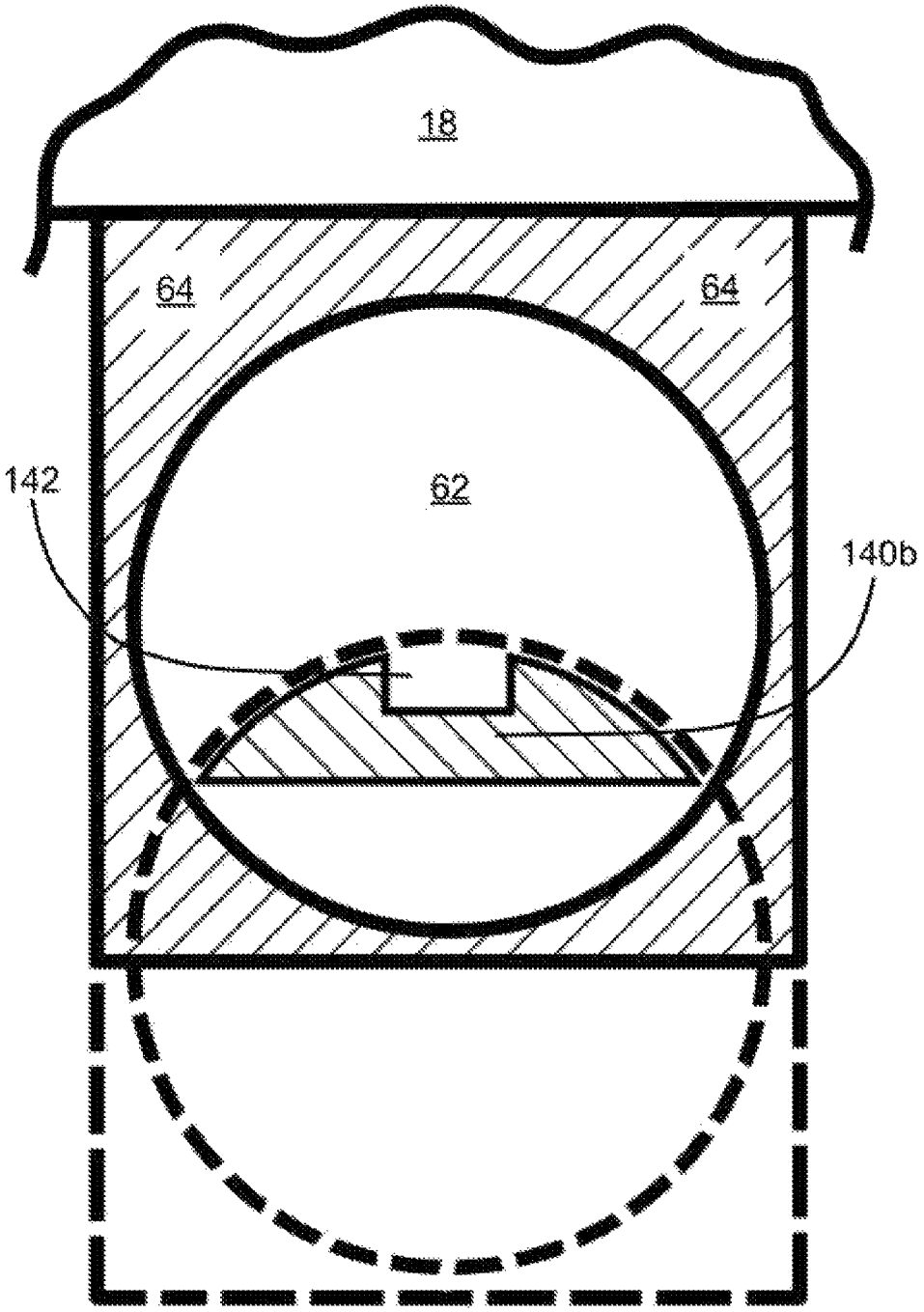
FIG. 22 shows a sectional view of the takedown pin of the present disclosure within the passage found in the upper receiver when the AR is not breached.

FIGS. 21 and 22 show a section view of takedown pin 140*b* in takedown passage 62 along the line C-C' in FIG. 20. FIG. 21 shows the orientation of takedown pin 140*b* in takedown passage 62 when the detent in lower receiver 16 is engaged with divot 146. Flange 64 from upper receiver 18 encloses takedown passage 62. In this orientation, takedown pin 140*b* is able to secure upper receiver 18 to lower receiver 16 such that the bolt carrier within upper receiver 18 and the buffer within stock 22 are aligned and the AR may be fired. FIG. 22 demonstrates the change in position of upper receiver 18 when the shooter rotates takedown pin 140*b* ninety degrees so that the detent in lower receiver 16 engages divot 145. The broken lines show the original position of flange 64 and takedown passage 62 while the solid lines show the position of flange 64 and takedown passage 62 once takedown pin 140*b* has been rotated 90 degrees clockwise. The cutout portion along the length of takedown pin 140*b* allows for angular displacement of the upper receiver 18 from lower receiver 16 so that the bolt carrier within upper receiver 18 and the buffer within stock 22 are misaligned.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A magazine (14) configured for automatic rifles (10) designed to receive magazines, where said automatic rifle has a catch (40) having a projection (48) to hold said magazine within said automatic rifle, said magazine comprising:

a container body for holding rounds (24) comprising
- an outer casing (30*a* and 30*b*) establishing front, back, bottom, left, and right walls;
- an exposed top;
- a flange extending from said left and right walls that arch above said top; and
- a window (38) to receive said projection so said magazine is held by said automatic rifle;

a follower (36) positioned within said container body to provide a platform for said rounds (24) to rest upon comprising
- an outer casing establishing front, back, bottom, top, and side walls;
- a roller (84) to remove said projection from said window and release said magazine from said automatic rifle said roller comprising
  - a wheel (114),
  - a first spring (118),
  - an axle (112) for said wheel to rotate about having
    - a proximal (120) end that engages said first spring,
    - a distal end (122) for said wheel to rotate about,
    - a fulcrum (116) between said proximal end and said wheel such that said axle may pivot about said fulcrum, and a second spring (34) positioned between said follower and the bottom of said container body to cause said follower to move up said container body as said rounds are removed.

2. The magazine of claim 1 further having a breach detection mechanism comprising:

a gap (90) in said flange extending from the left wall of said container body;

a rod (86) vertically installed within said follower between said axle distal end and the left wall of said follower said rod able to translate vertically and having
- a proximal end adjacent to distal end of said axle and
- a distal end that extends above said follower and through said gap; and a third spring (88) to bias said rod upward such that
- when there are no remaining rounds in said magazine that is inserted in said automatic rifle that is not breached, said rod is interposed between said axle and the left wall of said follower preventing said wheel from removing said projection from said window,
- when there are no remaining rounds in said magazine that is inserted in said automatic rifle that is breached, said rod is not interposed between said axle and the left wall of said follower thus allowing said wheel from removing said projection from said window.

3. The magazine of claim 1 further having an ejection assist mechanism (130) attached to the front of said magazine comprising a housing (132);

an ejection pin (134) vertically installed in said housing and able to translate vertically therein; and a fourth spring (136) to bias said ejection pin upward such that
- when said magazine is held by said projection said fourth spring is in compression and
- when said magazine is not held by said projection protruding into said window, said fourth spring will cause said ejection pin to push said magazine out of said automatic rifle.

* * * * *